US006496668B2

(12) United States Patent
Sato et al.

(10) Patent No.: US 6,496,668 B2
(45) Date of Patent: Dec. 17, 2002

(54) IMAGE DEVELOPING DEVICE WITH SEALING MEMBERS FOR PREVENTING TONER LEAKAGE

(75) Inventors: Fumikazu Sato, Inuyama (JP); Hideaki Deguchi, Nagoya (JP); Naoya Kamimura, Nagoya (JP); Mitsuru Horinoe, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/953,124

(22) Filed: Sep. 17, 2001

(65) Prior Publication Data

US 2002/0028086 A1 Mar. 7, 2002

Related U.S. Application Data

(63) Continuation-in-part of application No. 09/615,408, filed on Jul. 13, 2000, now Pat. No. 6,321,050.

(30) Foreign Application Priority Data

Jul. 14, 1999 (JP) ..... 11-200389
Aug. 23, 1999 (JP) ..... 11-235572

(51) Int. Cl.[7] ..... G03G 15/08
(52) U.S. Cl. ..... 399/103; 399/105

(58) Field of Search ..... 399/102, 103, 399/105, 222, 264, 265

(56) References Cited

U.S. PATENT DOCUMENTS

| | | | | |
|---|---|---|---|---|
| 5,134,960 | A | 8/1992 | Shirai | |
| 6,070,027 | A | 5/2000 | Kawai et al. | |
| 6,178,303 | B1 | 1/2001 | Ishii et al. | |
| 6,321,050 | B1 * | 11/2001 | Sato et al. | 399/103 |

* cited by examiner

*Primary Examiner*—Hoang Ngo
(74) *Attorney, Agent, or Firm*—Oliff & Berridge, PLC

(57) ABSTRACT

A developing device for developing a latent static-electric image into a visible image from developer. Various members for preventing toner leaks are attached to the developing case. A lower-edge leak prevention member is attached below the developer bearing body. End leak prevention members are attached on either side of the lower-edge leak prevention member, near lengthwise ends of a developer bearing body. Portions of the developing case where the end leak prevention members are attached, are indented lower than the portion where the lower-edge leak prevention member is attached. Resilient foam members are attached an the same surface as the lower-edge leak prevention member, with one side surface in contact with one side surface of the corresponding end leak prevention member.

18 Claims, 33 Drawing Sheets

IMAGE DEVELOPING DEVICE WITH SEALING MEMBERS FOR PREVENTING TONER LEAKAGE

CROSS-REFERENCE TO RELATED APPLICATION

This application is a continuation-in-part of U.S. patent application Ser. No 09/615,408, filed Jul. 13, 2000. Now U.S. Pat. No. 6,321,050.

BACKGROUND OF THE INVENTION

1. Field of the Invention

The present invention relates to a developing unit, a process cartridge, and a developing cartridge for developing images using developing agent.

2. Description of Related Art

A conventional image forming device includes a known developing unit that develops electrostatic latent images into visible images using charged particles of toner. This type of developing unit can leak toner. The leaked toner can stain the interior of the image forming device and recording sheets, thereby degrading printing quality. The leaked toner can also stain the user's hands or clothes during replacement of the developing unit.

One such developing unit with this problem includes a developing roller and a layer thickness regulating blade. The developing roller transports toner on its surface, and the layer thickness regulating blade regulates the toner on the surface of the developing roller to a thin layer. The layer thickness regulating blade includes a stainless steel plate spring and a resin or rubber pressing member, both formed to the same length in their lengthwise direction. Non magnetic single component developing agent is used as toner. The toner easily leaks from around the edges of the developing roller as the developing roller rotates.

Conventionally, various configurations have been provided inside the developing unit in order to prevent toner leakage. As will be described next, side seals and a lower film are examples of configuration provided for preventing toner leakage.

The side seals are formed from a urethane sponge with a Teflon™ felt attached thereto. The urethane sponge needs to be sufficiently soft and have a low compression set. The Teflon™ felt can be pressed with sufficient pressing force against the developing roller, without increasing rotational torque required for rotating the developing roller.

The lower film is usually made from urethane rubber or a polyethylene terephthalate (PET) sheet. Although the urethane rubber provides a sufficiently soft pressing force, it has insufficiently low stiffness on its own, and so needs to be pressed from behind by a sponge or other member. The PET sheet is stiffer than the urethane rubber film and so does not need to be pressed from behind by a sponge member. Therefore, the PET sheet makes assembly processes easier than does the urethane rubber film.

SUMMARY OF THE INVENTION

However, the present inventors have discovered that when side seals and a lower film are used in configuration for preventing leaks, toner can easily leak between contacting surfaces of the lower film and the side seal while the side seal rubs against the outer periphery surface of the developing roller. For example, if the lower film is extended toward, but does not overlap with, the side seals, then toner can leak through gaps between the lower film and the side seals. On the other, if the lower film is extended to span across the side seals, so that the ends of the side seal extend beyond the side seals, then a step will develop where the lower film overlaps with each side seal. In this case, when the developing roller is disposed in contact with both of the lower film and the side seal, these steps form small gaps equivalent to the thickness of the lower film. Toner can leak through these gaps.

Polymerized toner has excellent fluidity. Therefore, when polymerized toner is used it can easily leak through even the smallest gaps.

It is conceivable to extend the ends of the lower film to near the center of where the side seals slide against the developing roller. With this conceivable configuration, the step portion between the lower film and the side seal will end at the end of the lower film, that is, near the middle of the side seal. As a result, the gap will be cut off near the middle of the side seal, so even it polymerized toner is used, toner leaks can be almost completely prevented. However, this conceivable configuration also has a leak problem because of the following circumstances.

The side seals must be formed with a thickness that takes into consideration the amount that they are compressed by the developing roller. If the compression amount of the side seals is too small, then the pressing force against the developing roller will be too small to provide a proper seal, so that toner will leak. On the other hand, if the compression force of the side seals is too large, then an excessively large pressing force will develop between the side seals and the developing roller. As a result, a great deal of rotational torque will be required to rotate the developing roller. In order to achieve an optimum pressing force, it is conceivable to form the case with the surfaces where the side seals are attached retracted lower than the surface where the lower seal is attached. The side seals are then adhered into these indented attachment areas.

However, with this conceivable configuration, a step is formed between the indented side seal attachment area and the lower seal attachment area. When the developing roller presses down on the side seals, the side seals slide along the surface of the step portion as they compress. Also, during developing operations the side seals vibrate slightly in association with rotation of the developing roller, so that the side surface of the side seals slightly slides against the surface of the step portion. Because the side seal must be able to slide against the surface of the step portion in these instances, the side surface of the side seal cannot be adhered to the surface of the step portion, for example, by two-sided tape. Also, the interface between the plastic surface of the step portion and the sponge material of the side seals has extremely poor sealing properties, so polymerized toner, which has a extremely high fluidity, can easily leak between such an interface.

Also, the developing roller is not yet installed when ends of the lower film are being attached to the side seals, so the side seals are not yet compressed by the developing roller at this time. Therefore, if the ends of the lower film are extended to near the center of where the side seals slide against the developing roller, then the lower film must be bent upward because of the difference in height between the lower film attachment area and the upper surface of the side seals. Afterward, when the developing roller is attached, the side seals and also both ends of the lower film are compressed by the developing roller. As a result, the lower film can deform or shift out of position from where it is adhered, thereby lowering its sealing capacity.

It is an objective of the present invention to overcome the above-described problems, and to provide a developing unit and a process cartridge capable of reliably preventing toner leaks from connecting portions between a lower film and side seals.

To achieve this objective, a developing device according to a first aspect of the present invention is for developing a latent static-electric image into a visible image from developer, wherein the developing device includes a developing case, a developer bearing body, end leak prevention members, a lower-edge leak prevention member, and attachment-surface-border leak prevention members having the following configuration.

The developing case is for holding developer. The developing case is formed with an opening that extends in a lengthwise direction. The developing case includes a lower-edge attachment surface and two end attachment surfaces at the opening. The end attachment surfaces are on either side of and bordering the lower-edge attachment surface in the lengthwise direction and are indented with respect to the lower-edge attachment surface.

The developer bearing body is disposed in the opening of the developing case in confrontation with the latent static-electric image, with lengthwise ends of the developer bearing body rotatably supported on the developing case.

The end leak prevention members are each attached on a corresponding end attachment surface of the developing case. Each is in sliding contact with a corresponding peripheral surface of the developer bearing body near a corresponding lengthwise end of the developer bearing body.

The lower-edge leak prevention member is attached on the lower-edge attachment surface of the developing case and extends in the lengthwise direction. The lower-edge leak prevention member is in sliding contact along a length of the developer bearing body at a position downstream, with respect to rotational direction of the developer bearing body, from where the developer bearing body confronts the latent static-electric image.

The attachment-surface-border leak prevention members are each made from a resilient foam material. Each is attached to the lower-edge attachment surface at a corresponding border position between the lower-edge attachment surface and a corresponding end attachment surface, with at least a portion of one side surface in contact with a portion of one side surface of a corresponding end leak prevention member.

According to a second aspect of the present invention, a process cartridge adapted for free attachment and detachment with respect to an image forming device, includes a latent static-electric image bearing body formed with a latent static-electric image; and the developing device according to the first aspect of the present invention.

According to a third aspect of the present invention, a developing device includes a developing case, a developer bearing body, a lower-edge leak prevention member, and end leak prevention members with the following configuration.

The developing case is for holding developer. The developing case is formed with an opening that extends in a lengthwise direction. The developing case includes a lower-edge attachment surface.

The developer bearing body is disposed in the opening of the developing case in opposition with the latent static-electric image.

The lower-edge leak prevention member extends in the lengthwise direction of the opening and includes an attached portion and a free end. The attached portion is attached on the lower-edge attachment surface of the developing case. The free end is in sliding contact along a length of the developer bearing body downstream, with respect to rotational direction of the developer bearing body, from where the developer bearing body confronts the latent static-electric image.

The end leak prevention members each include a sliding contact member and a resilient base member. Each sliding contact member is in sliding contact with a corresponding peripheral surface of the developer bearing body near a corresponding lengthwise end of the developer bearing body. Each base member as an upstream end with respect to rotational direction of the developer bearing body. The upstream end of each base member s positioned in an overlapping condition with the lower film 114 between the free end of the lower-edge leak prevention member and where the lower-edge leak prevention member is attached to the lower-edge attachment surface with respect to rotational direction of the developer bearing body.

According to a fourth aspect of the present invention, a process cartridge adapted for free attachment and detachment with respect to an image forming device, includes a latent static-electric image bearing body formed with a latent static-electric image; and the developing device according to the third aspect of the present invention.

According to a fifth aspect of the present invention, a developing device includes a developing case, a developer bearing body, end leak prevention members, a lower-edge leak prevention member, and attachment-surface-border leak prevention members with the following configuration.

The developing case is for holding developer. The developing case is formed with an opening that extends in a lengthwise direction. The developing case is provided with end attachment surfaces and a lower-edge attachment surface. The end attachment surfaces is formed lower than the lower-edge attachment surface.

The developer bearing body is disposed in the opening of the developing case in opposition with the latent static-electric image, with lengthwise ends of the developer bearing body rotatably supported on the developing case.

The end leak prevention members each slidingly contact a corresponding peripheral surface of the developer bearing body near a corresponding lengthwise end of the developer bearing body.

The lower-edge leak prevention member is attached on the lower-edge attachment surface of the developing case and extends in the lengthwise direction. The lower-edge leak prevention member is in sliding contact along a length of the developer bearing body.

The attachment-surface-border leak prevention members formed from a resilient foam material, and is disposed at borders between the lower-edge attachment surface and the end attachment surfaces. The lower-edge leak prevention member exposes the attachment-surface-border leak prevention members between the lower-edge leak prevention member and the end leak prevention members.

According to a sixth aspect of the present invention, a process cartridge adapted for free attachment and detachment with respect to an image forming device, includes a latent static-electric image bearing body formed with a latent static-electric image; and the developing device according to the fifth aspect of the present invention.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE EMBODIMENTS

A laser beam printer 1 including a developing unit according to a first embodiment of the present invention will be described while referring to FIGS. 1 to 15(B).

Figure 1:
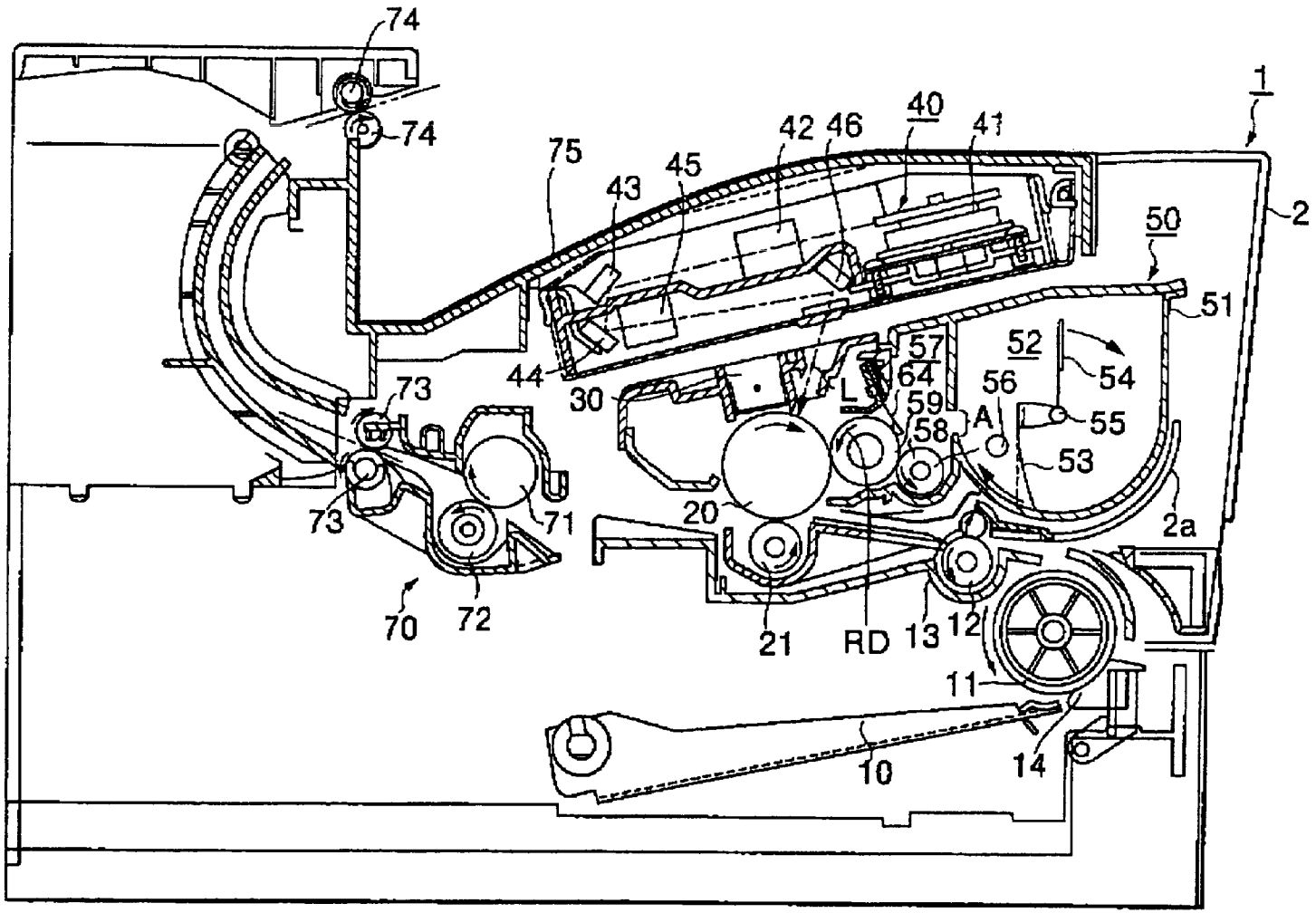
FIG. 1 is a cross-sectional view showing configuration of an image forming device according to a first embodiment of the present invention.
Figure 2:
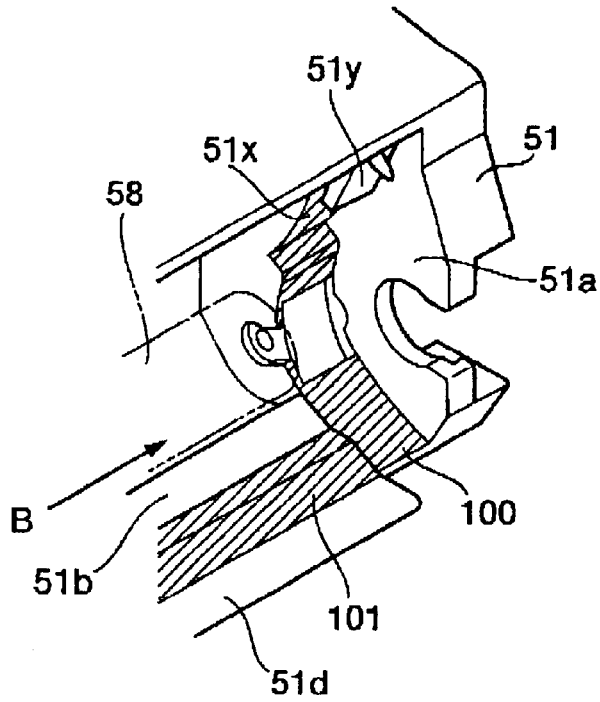
FIG. 2(A) is a partial perspective view showing the developing case before any seal configuration is attached.
FIG. 2(B) is a cross-sectional view showing the developing case from the direction indicated by an arrow B in FIG. 2(A)
Figure 2:
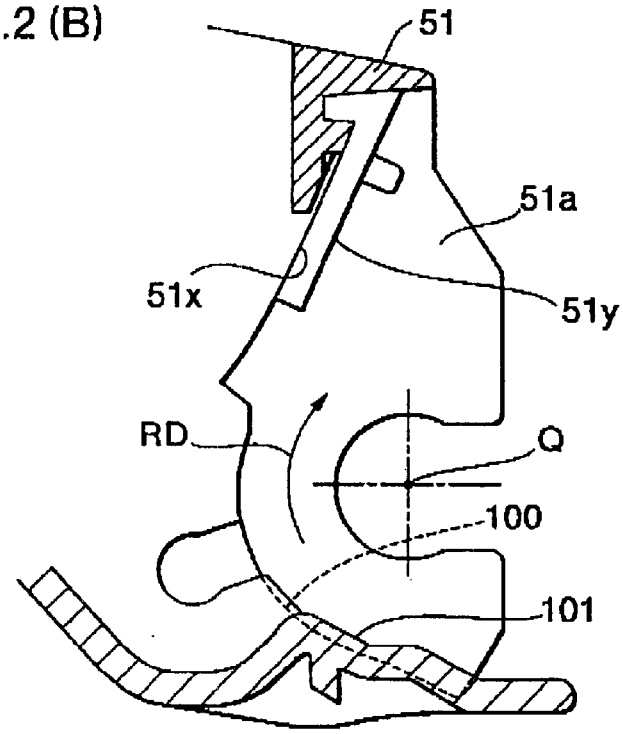

As shown in FIG. 1, the laser beam printer 1 includes a case 2, a feeder unit 15 for supplying sheets (not shown) stored in a stack at the bottom portion of the case 2, a laser scanner unit 40, a developing unit 50, and various components aligned along a sheet transport pathway along which sheets are transported from the feeder unit 15 to be discharged from the printer 1.

The feeder unit includes a friction separation member 14, a sheet supply roller 11, and a sheet pressing plate 10. The sheet pressing plate 10 is pressed upward by a spring (not shown), and presses the sheets upward against the sheet supply roller 11. When the sheet supply roller 11 rotates in the direction indicated by an arrow in FIG. 1, the uppermost sheet of the stack is separated from between the sheet supply roller 11 and the friction separation member 14. One sheet at a time is supplied in this manner at a predetermined timing.

A pair of register rollers 12 and 13 are rotatably supported at a position downstream along the pathway which sheets are transported by rotation of the sheet supply roller 11. The pair of register rollers 12 and 13 perform a regist operation at a predetermined timing to align the front edge of sheets from the feeder unit 15.

A transfer roller 21 and a photosensitive drum 20 are disposed along the sheet transport pathway, at a position downstream from the register rollers 12, 13. The transfer roller 21 and the photosensitive drum 20 define therebetween a transfer position where the register rollers 12, 13 transport sheets after registration operations.

The photosensitive drum 20 is rotatably supported on the case 2, and driven by a drive means (not shown) to rotate in a direction indicated by an arrow in FIG. 1. The photosensitive drum 20 is configured from a hollow drum with an aluminum cylindrical sleeve as its main body. An organic photoconductive layer is formed on the outer peripheral surface of the cylindrical sleeve to a predetermined thickness of, for example, about 20 $\mu$m. The photoconductive layer is formed from positively-charging polycarbonate as its main component. A photoconductive resin is dispersed in the polycarbonate. The photosensitive drum 20 can have other configurations that provide it with a positively charging nature.

The transfer roller 21 is configured from a resilient foam body having electrical conductivity. The resilient foam body is formed from silicon rubber or urethane rubber, for example, and is freely rotatably supported. The transfer roller 21 is applied with a voltage, so that the toner image on the photosensitive drum 20 is reliably transferred to a sheet transported between the photosensitive drum 20 and the transfer roller 21.

A charge unit 30 is disposed adjacent to the photosensitive drum 20. The charge unit 30 is configured from, for example, a positively charging scorotoron charge unit that generates a corona discharge from a charge wire, which is formed from tungsten for example.

The laser scanner unit 40 includes a laser generator (not shown), a polygon mirror (five-surfaced mirror) 41 that is driven to rotate, a pair of lenses 42 and 45, and reflection mirrors 43, 44, and 46. The laser generator generates a laser light L to form an electrostatic latent image on the photosensitive drum 20.

The developing unit 50 includes a developing case 51 formed with a toner holding chamber 52 and a developing chamber 57. A rotational shaft 55 is provided in the toner holding chamber 52. An agitator 53 for agitating the toner and transferring the toner into the developing chamber 57, and a cleaning member 54 are fixed on the shaft 55, and so rotate in association with rotation of the shaft 55. Also, light transmission windows 56 are provided in the inner walls of the toner holding chamber 52, one adjacent to each end of the rotational shaft 55.

The toner holding chamber 52 is filled with a nonmagnetic single-component toner that has a positively charging nature and electrically insulating properties. The toner base particles have a particle diameter of between 6 microns and 10 microns, and an average particle diameter of 8 microns. The toner base particles are formed by adding a well-known coloring agent, such as carbon black, and a charge control agent, such as nigrosine, triphenylmethane, and quaternary ammonium salt, to styrene acryl resin that has been formed in spheres by suspension polymerization. The toner is configured by adding silica as an outer additive to the surface of the toner base particles.

The developing chamber 57 is formed nearer the photosensitive drum 20 than is the toner holding chamber 52, and includes a portion for rotatably supporting a toner supply roller 58 and a developing roller 59. The developing roller 59 is driven to rotate in a rotational direction indicated by arrows RD in FIGS. 1, 2(B), 5(B), and 14(D). The toner supply roller 58 supplies toner from the toner holding chamber 52 to the developing roller 59. A layer thickness regulating blade 64 having a resilient thin shape is disposed in the developing chamber 57, for regulating toner supplied by the toner supply roller 58 to a predetermined thickness on the developing roller 59.

The developing roller 59 supplies the layer of toner to develop the electrostatic latent image formed on the photosensitive drum 20 by the laser scanner unit 40. The developing unit 59 includes a metal core formed from stainless steel and a cylindrical base member provided on the metal core. The base member is formed from a conductive silicon rubber including particles of conductive carbon. A coating is formed an top of the base member. The coating is formed from a resin or rubber that includes fluorine. It should be noted that the base member of the developing roller 59 can be formed from a conductive urethane rubber rather than from conductive silicon rubber.

A fixing unit 70 is provided along the sheet transport pathway, at a position further downstream from the photosensitive drum 20 and the transfer roller 21. The fixing unit 70 includes a heat roller 71 and a pressing roller 72. The heat roller 71 and the pressing roller 72 press and heat the toner image transferred from the photosensitive drum 20 onto a sheet, thereby fixing the toner image onto the sheet. A pair of transport rollers 73 and a pair of discharge rollers 74 for transporting the sheet are each provided along the sheet transport pathway further downstream from the pressing roller 72. A discharge tray 75 is provided downstream from the discharge rollers 74.

It should be noted that the transfer roller 21, the charge unit 30, the photosensitive drum 20, and the developing unit 50 are housed in a process cartridge case 2*a*, which is detachable from the laser beam printer 1. Further, the developing unit 50 is freely detachable from the process cartridge case 2*a*, and functions as a developing unit cartridge.

Image formation operations that the laser beam printer 1 performs to form an image on a sheet will be described briefly here. The charge unit 30 uniformly charges the surface of the photosensitive drum 20. Then the laser scanner unit 40 emits laser light L as modulated according to image information, to form an electrostatic latent image on the surface of the photosensitive drum 20. The developing unit 50 develops the latent image into a visible image using toner. The photosensitive drum 20 rotates to transport the visible image toward the transfer position between the transfer roller 21 and the photosensitive drum 20. At this time, the sheet supply roller 11 and the register rollers 12 and 13 supply a sheet to the transfer position. The transfer roller 21 is applied with a transfer bias to transfer the visible toner image on the photosensitive drum 20 onto the sheet transported to the transfer position. It should be noted that any toner remaining on the photosensitive drum 20 after transfer is collected by the developing roller 59 and returned to the developing chamber 57.

Next, the sheet with the toner image is transported between the heat roller 71 and the pressing roller 72 of the fixing unit 70. The heat roller 71 and the pressing roller 72 press and heat the visible image on the sheet, and fix the image onto the sheet. The sheet is then discharged onto the discharge tray 75 by the pair of the transport rollers 73 and the pair of the discharge rollers 74. This completes image formation operations.

Figure 3:
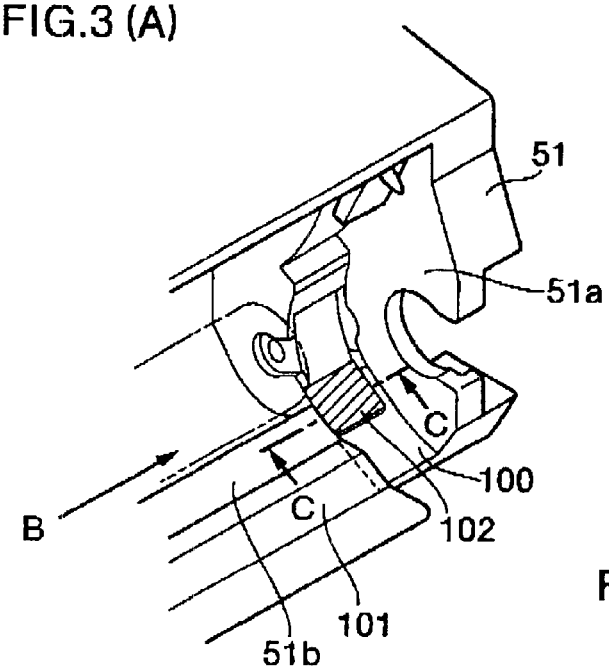
FIG. 3(A) is a partial perspective view showing the developing case after a side edge seal has been attached.
FIG. 3(B) is a cross-sectional view taken along a line C-C of FIG. 3(A)
FIG. 3(C) is a cross-sectional view showing the developing case and seal configuration as viewed from the direction indicated by an arrow B in FIG. 3(A)
Figure 3:
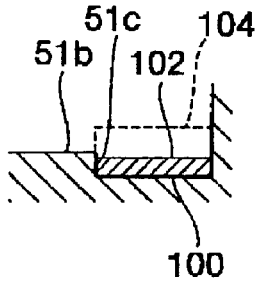
Figure 3:
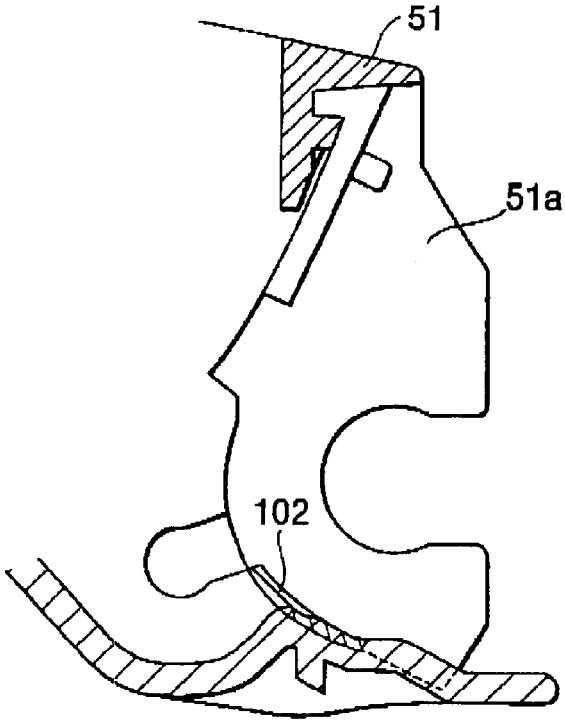
Figure 4:
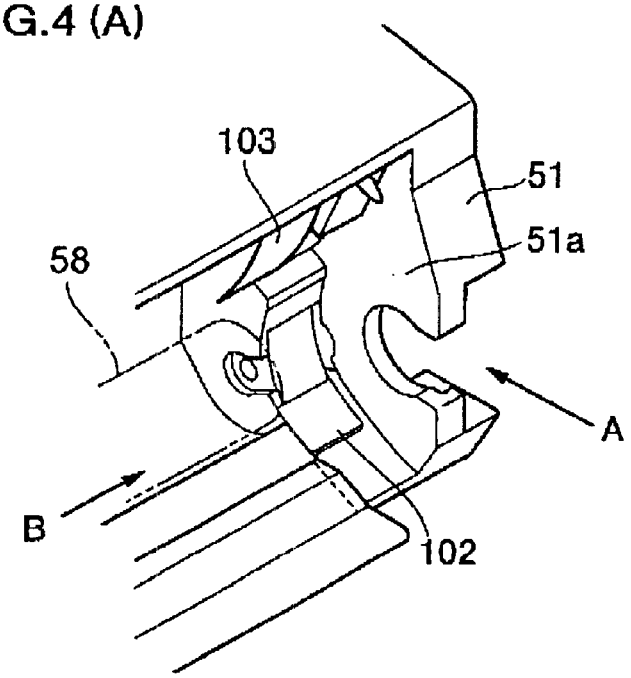
FIG. 4(A) is a partial perspective view showing the developing unit case after PET film has been attached.
FIG. 4(B) is a partial plan view showing the developing case and seal configuration from a direction indicated by an arrow A in FIG. 4(A)
FIG. 4(C) is a cross-sectional view showing the developing case and seal configuration as viewed from the direction indicated by an arrow B in FIG. 4(A)
Figure 4:
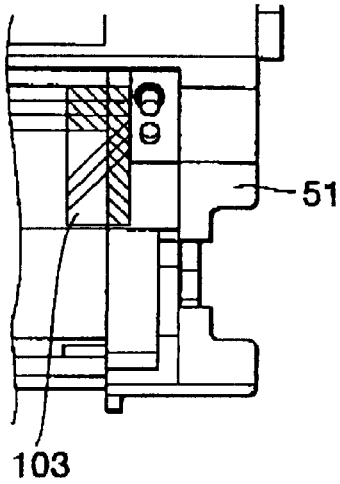
Figure 4:
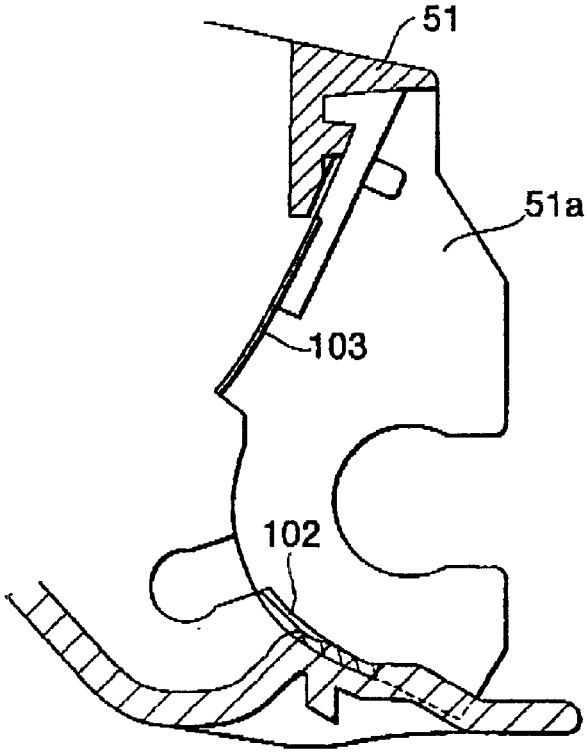
Figure 5:
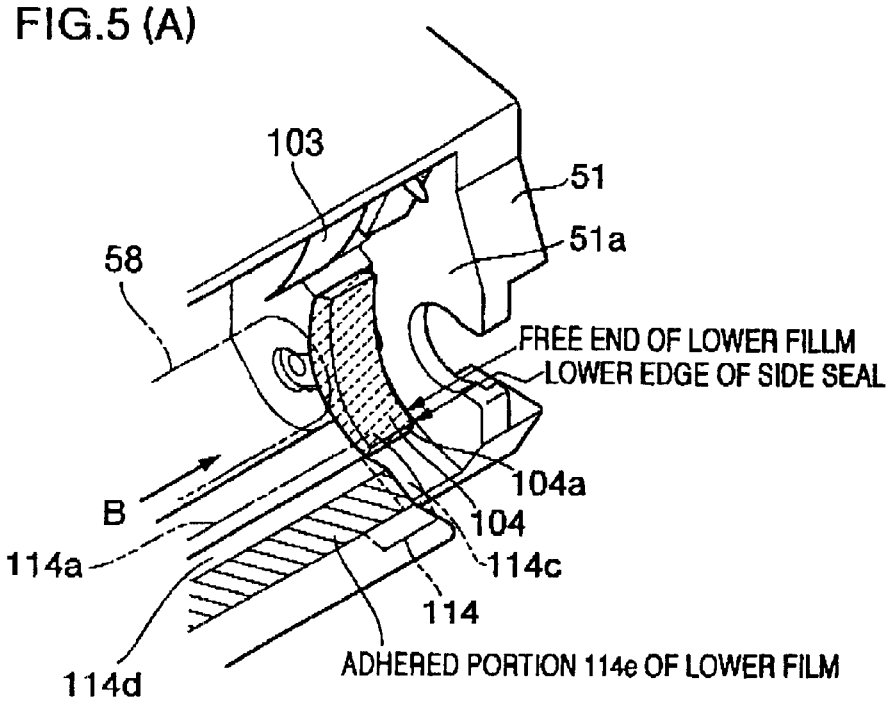
FIG. 5(A) is a partial perspective view showing the developing unit case after a side seal has been attached.
FIG. 5(B) is a cross-sectional view showing the developing case and seal configuration as viewed from the direction indicated by an arrow B in FIG. 5(A)
Figure 5:
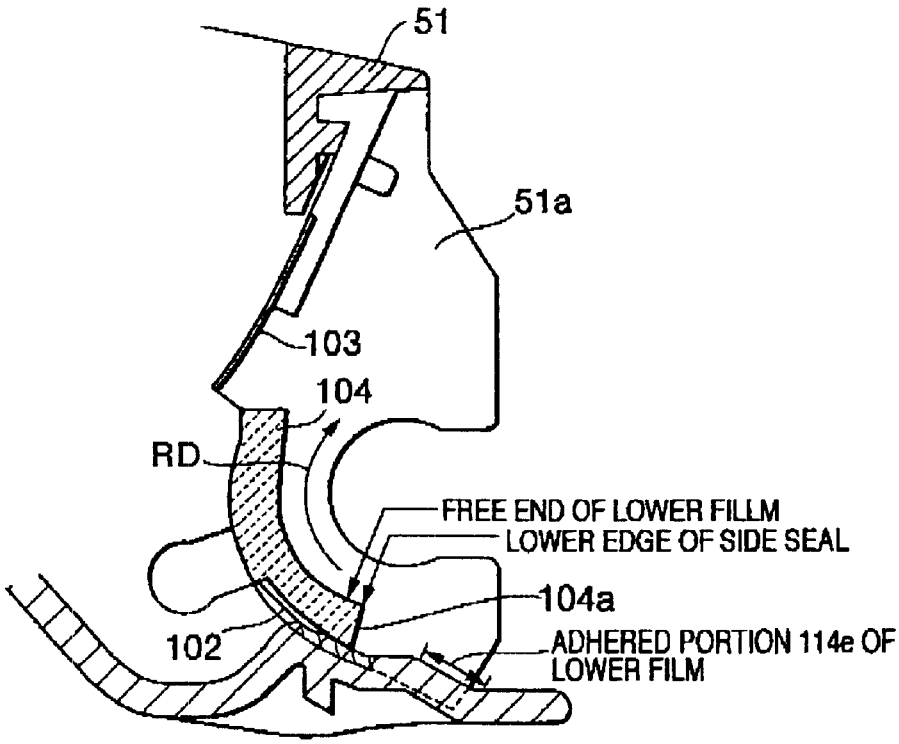
Figure 6:
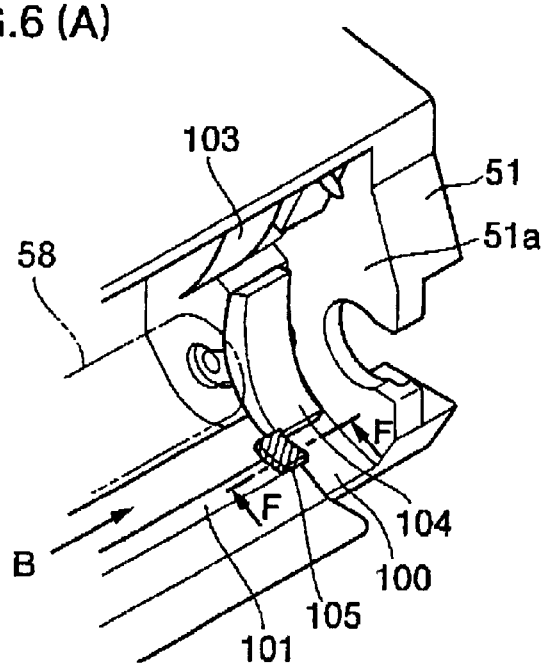
FIG. 6(A) is a partial perspective view showing the developing unit case after a lower side seal has been attached.
FIG. 6(B) is a cross-sectional view taken along a line F—F of FIG. 6(A)
FIG. 6(C) is a cross-sectional view showing the developing case and seal configuration as viewed in the direction indicated by an arrow B in FIG. 6(A)
Figure 6:
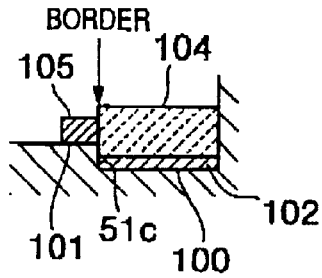
Figure 6:
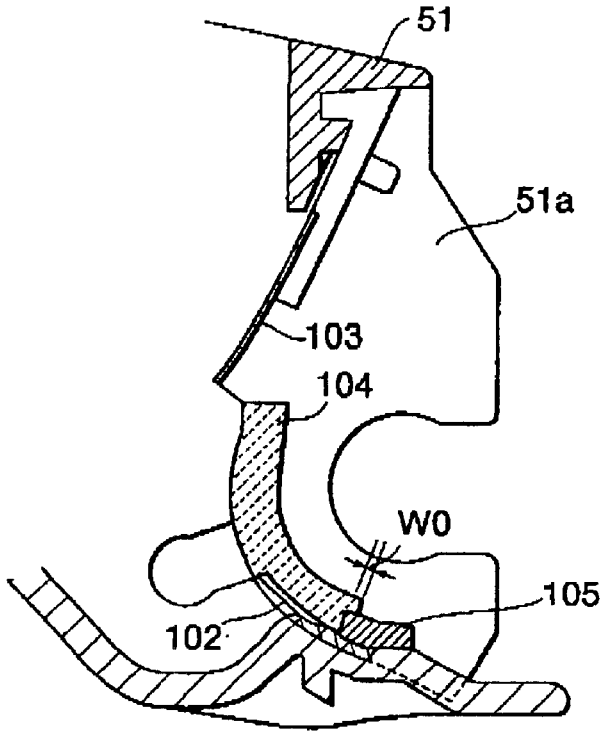
Figure 7:
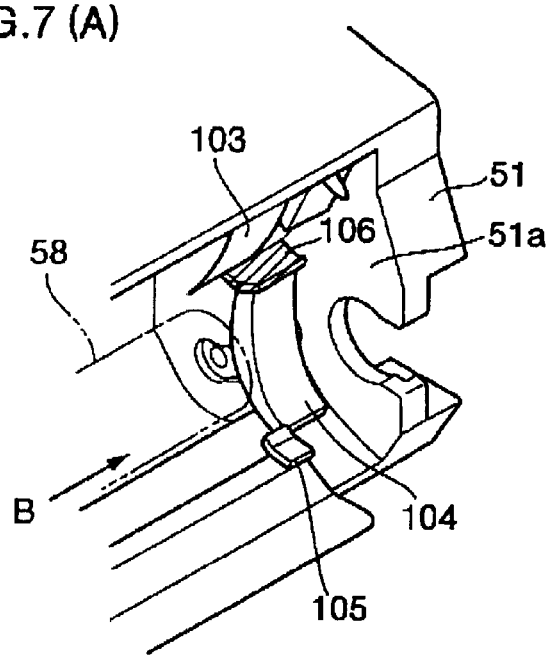
FIG. 7(A) is a partial perspective view showing the developing case after an end seal has been attached.
FIG. 7(B) is a cross-sectional view showing the developing case and seal configuration viewed from the direction indicated by an arrow B in FIG. 7(A)
Figure 7:
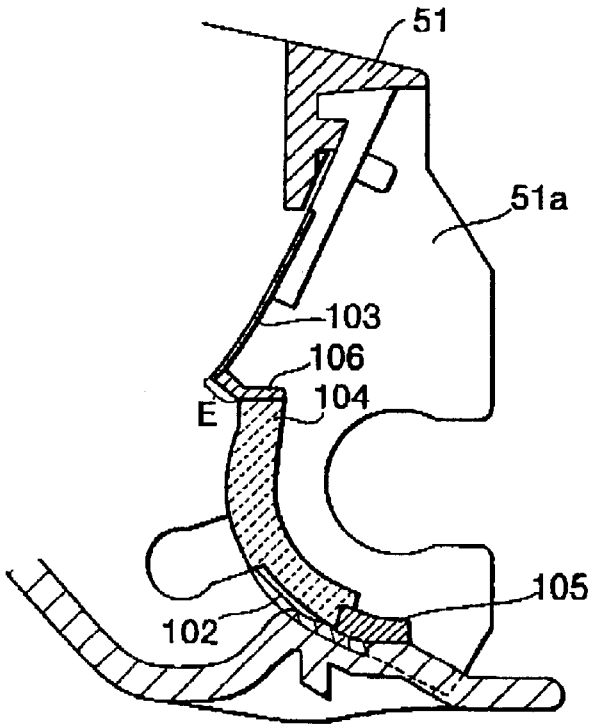
Figure 8:
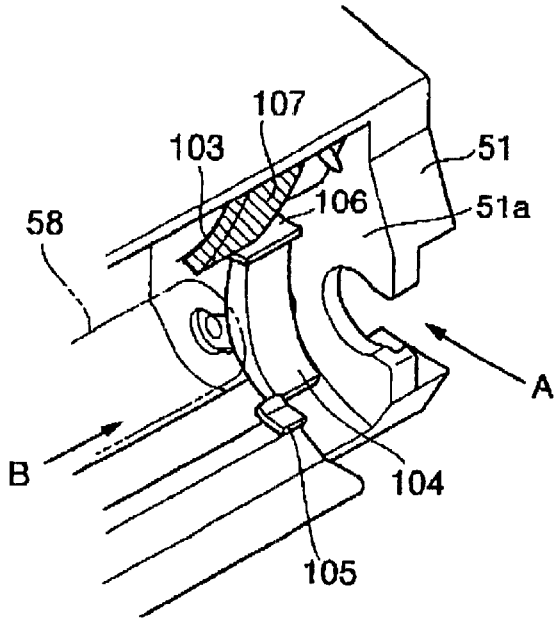
FIG. 8(A) is a partial perspective view showing the developing case after an upper side seal has been attached.
FIG. 8(B) is a plan view showing the developing case and seal configuration from the direction indicated by an arrow A in FIG. 8(A)
FIG. 8(C) is a cross-sectional view showing the developing case and seal configuration as viewed in the direction indicated by an arrow B in FIG. 8(A)
Figure 8:
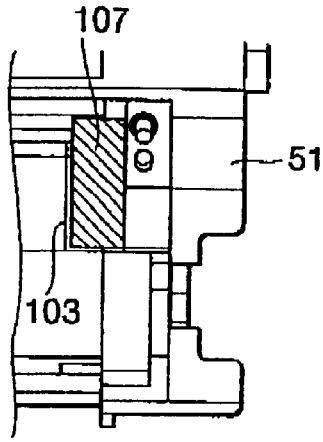
Figure 8:
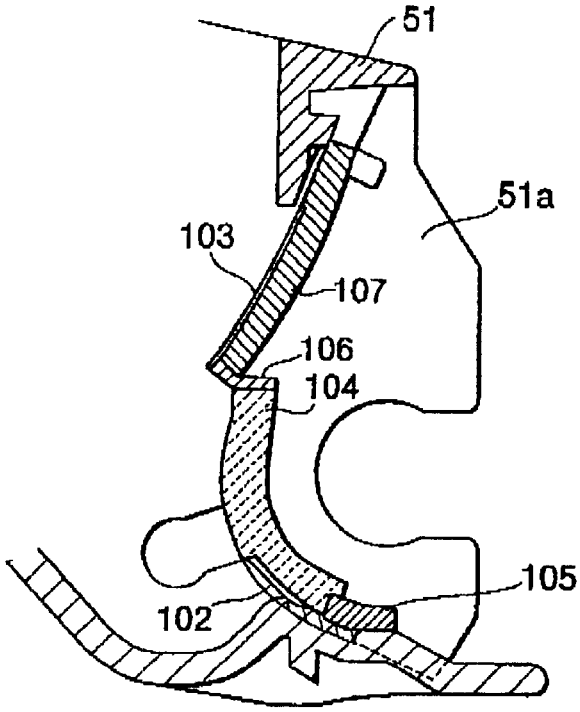
Figure 9:
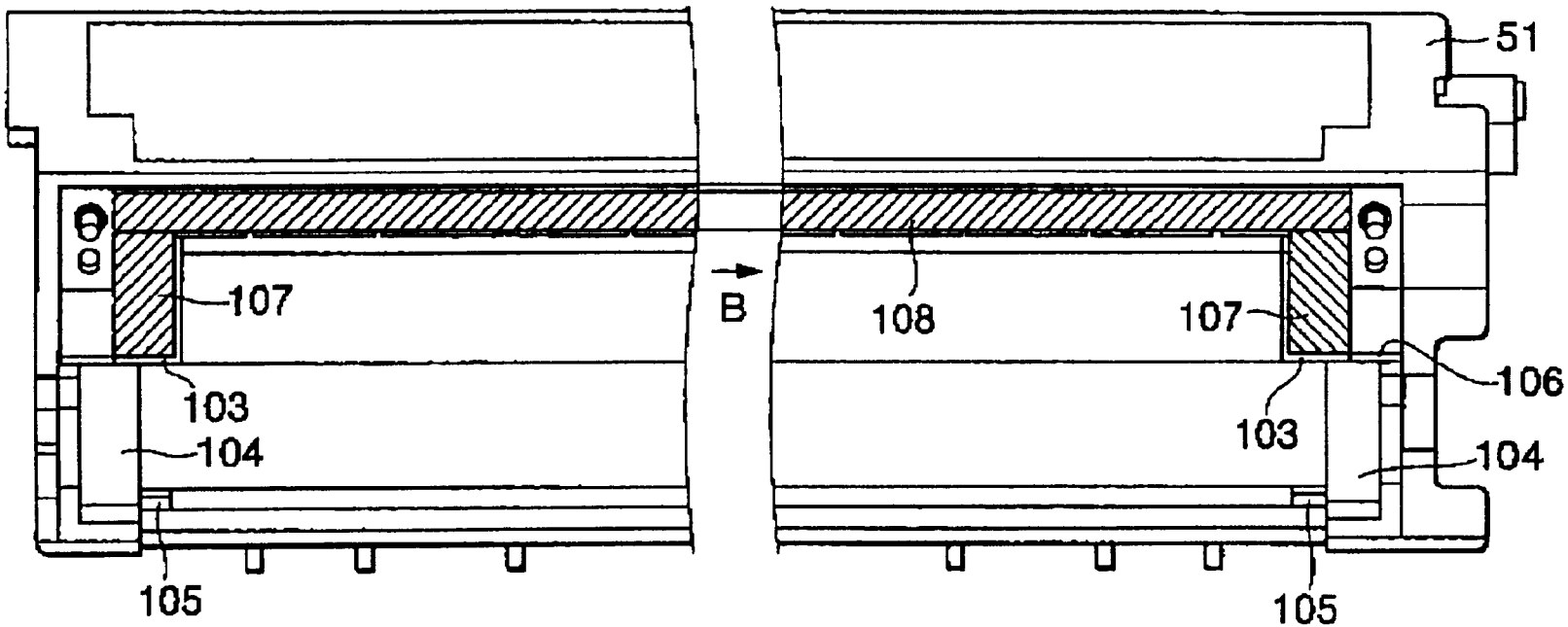
FIG. 9(A) is a front view showing the developing case after an upper seal has been attached.
FIG. 9(B) is a cross-sectional view showing seal configuration as viewed from the direction indicated by an arrow B in FIG. 9(A)
Figure 9:
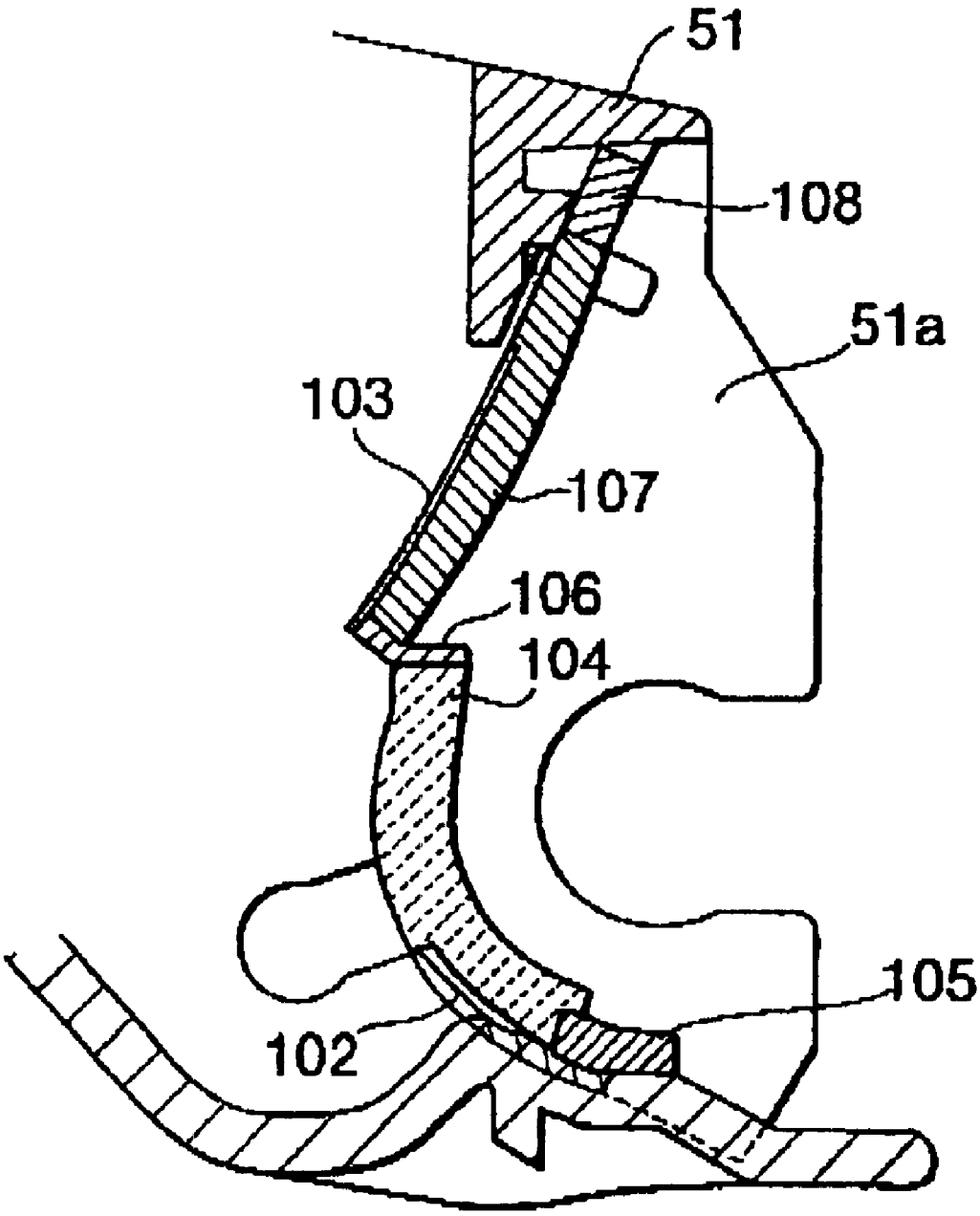
Figure 10:
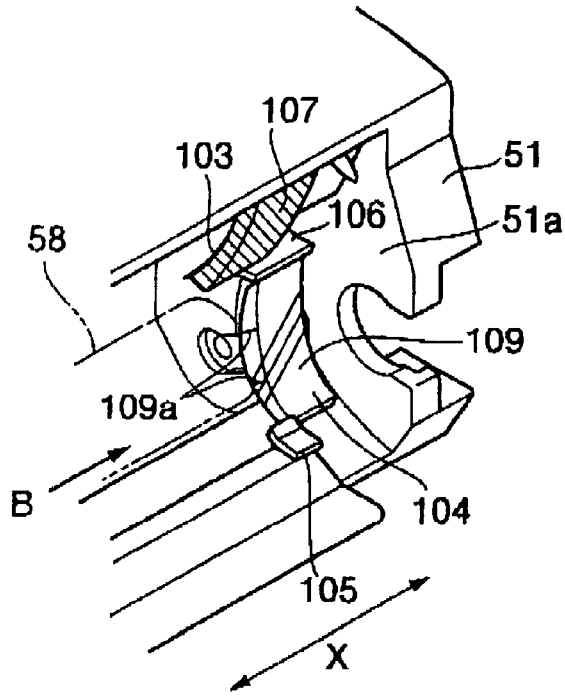
FIG. 10(A) is a partial-perspective view showing the developing case after an intermediate layer film has been attached.
FIG. 10(B) is a cross-sectional view showing the seal portion from the direction indicated by an arrow B in FIG. 10 (A)
Figure 10:
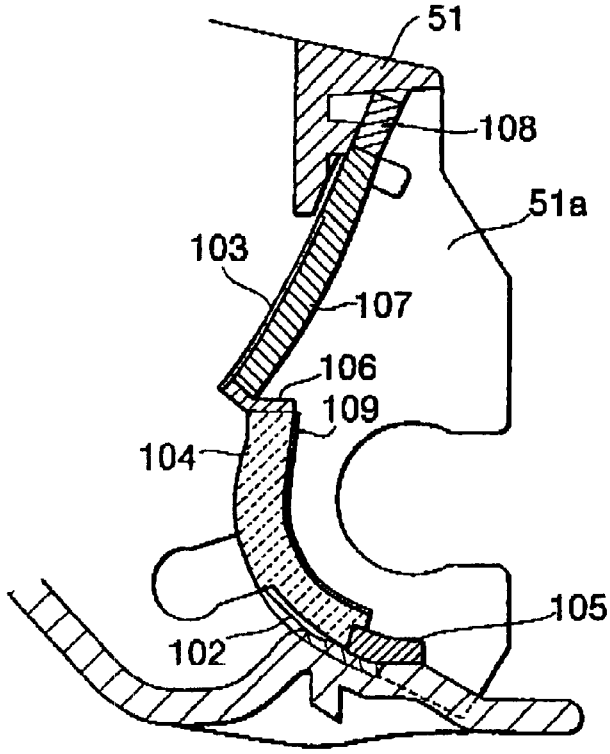
Figure 11:
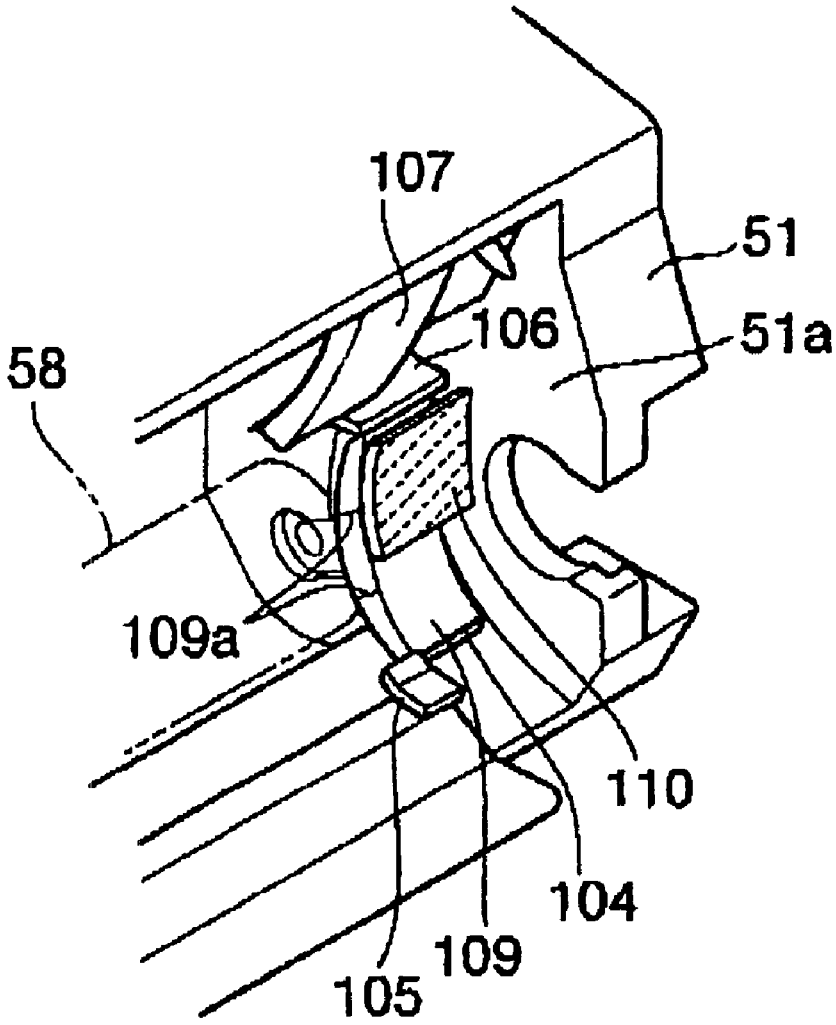
FIG. 11 is a partial perspective view showing the developing unit case after a side edge seal has been attached.
Figure 12:
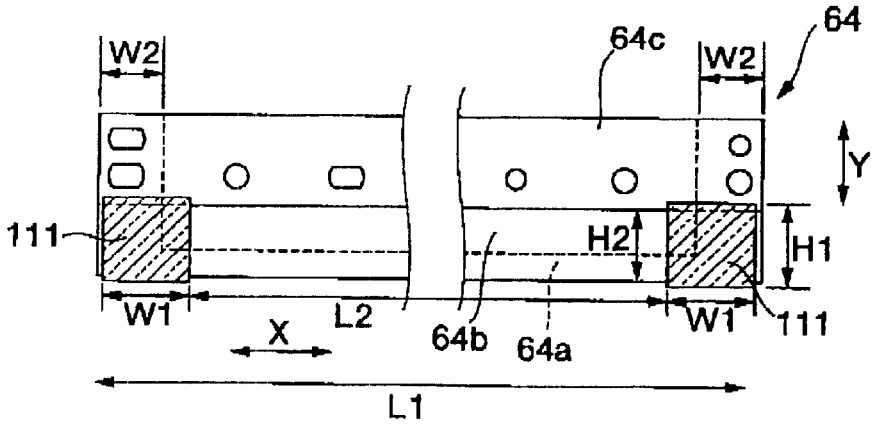
FIG. 12(A) is a plan view showing a rear surface of a layer thickness regulating blade of the image forming device of FIG. 1.
FIG. 12(B) is a plan view showing a front surface of the layer thickness regulating blade.
FIG. 12(C) is a cross-sectional view showing the layer thickness regulating blade attached in the developing unit case.
Figure 12:
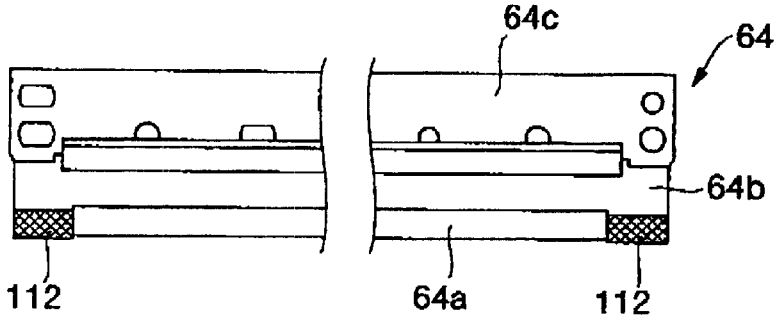
Figure 12:
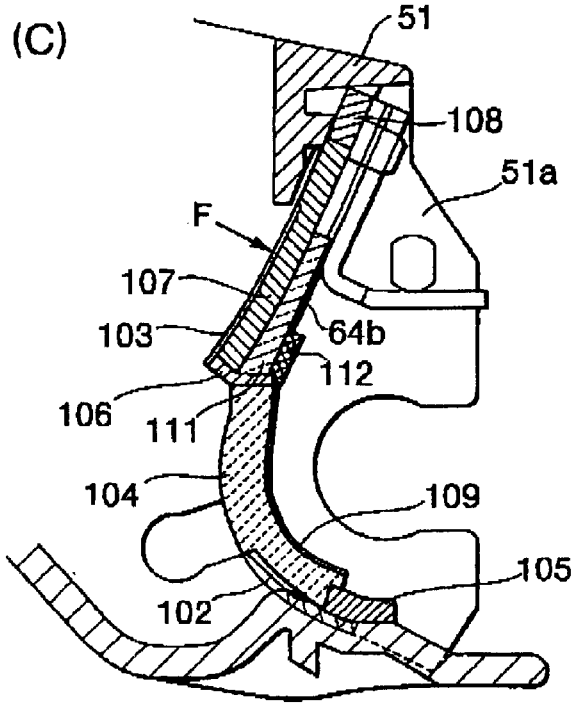
Figure 13:
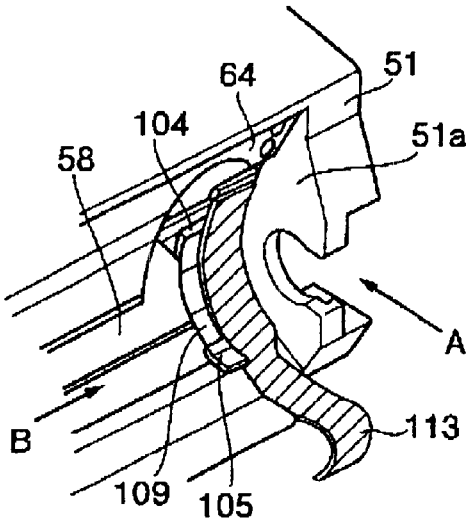
FIG. 13(A) is a partial perspective view showing the developing unit case after a Teflon™ felt contact member has been attached.
FIG. 13(B) is a plan view showing the seal configuration as viewed from a direction indicated by an arrow A in FIG. 13(A)
FIG. 13(C) is a cross-sectional view showing the developing case and the seal configuration as viewed from the direction indicated by an arrow B in FIG. 13(A)
FIG. 13(D) is a cross-sectional view taken along the line D—D in FIG. 13(C)
Figure 13:
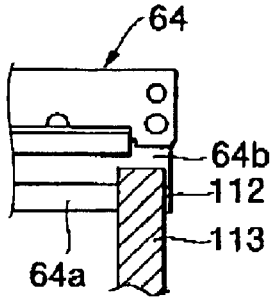
Figure 13:
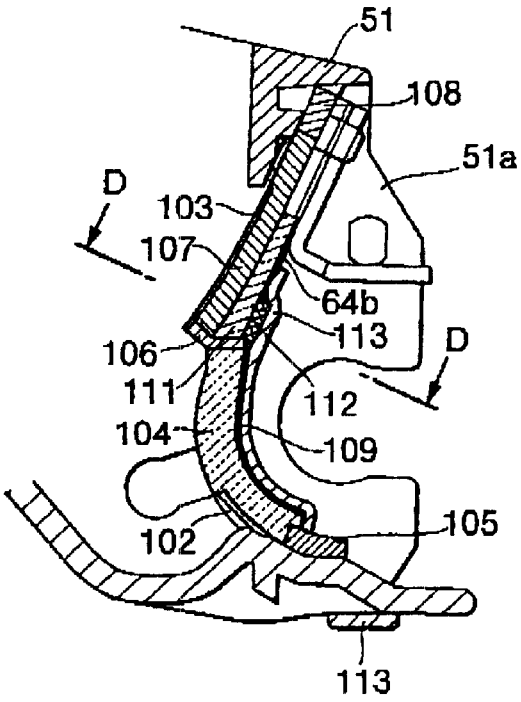
Figure 13:
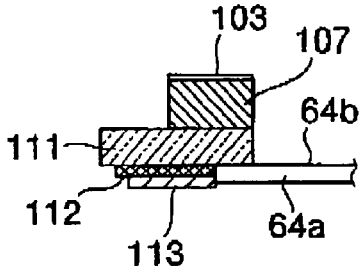
Figure 14:
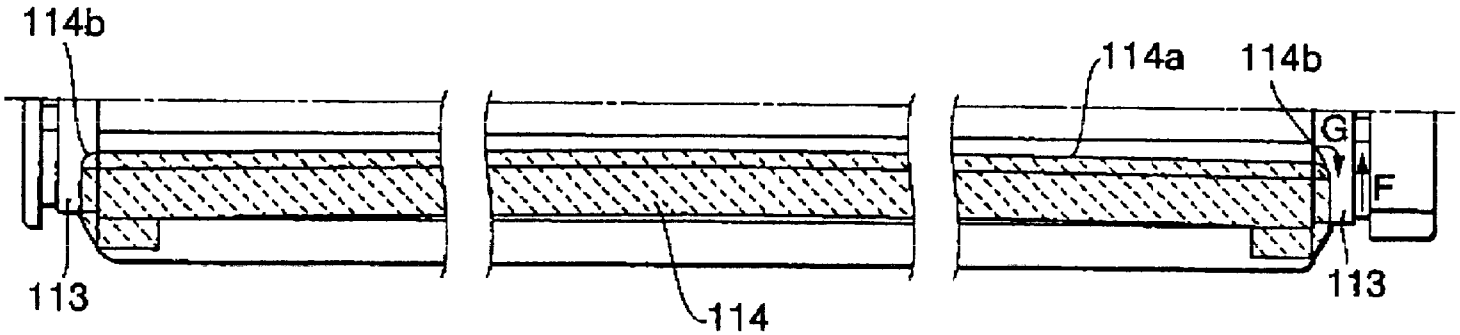
FIG. 14(A) is a plan view showing a lower seal attachment region of the developing case with a lower film attached thereto.
FIG. 14(B) is a plan view showing the lower seal attachment region with the lower film.
FIG. 14(C) is a partial cross-sectional view showing seal configuration of FIG. 14(B) at one lengthwise end of a developing unit case of the image forming device.
FIG. 14(D) is a cross-sectional view showing seal configuration as viewed from the direction indicated by arrow B in FIG. 14(D)
Figure 14:
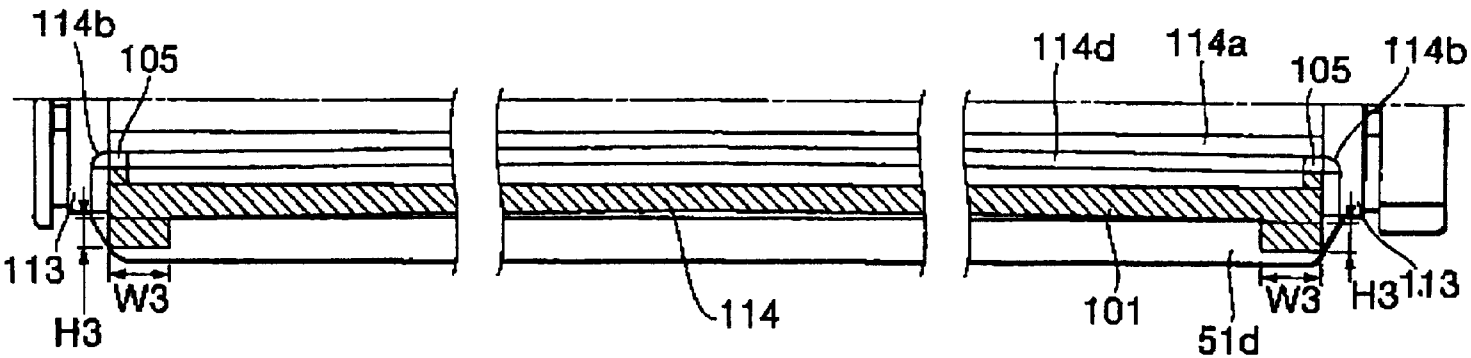
Figure 14:
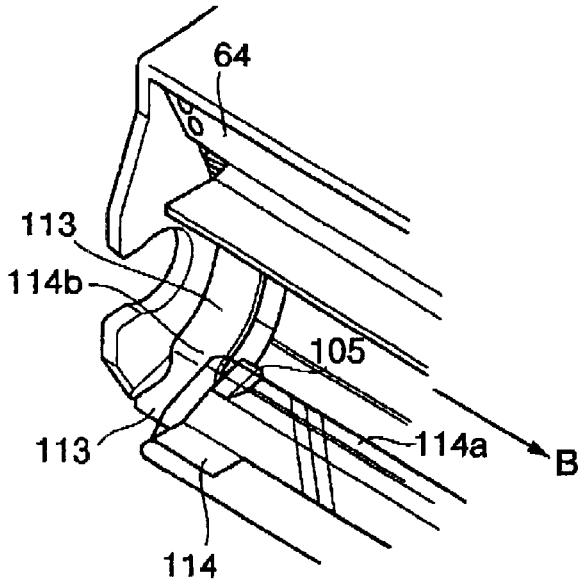
Figure 14:
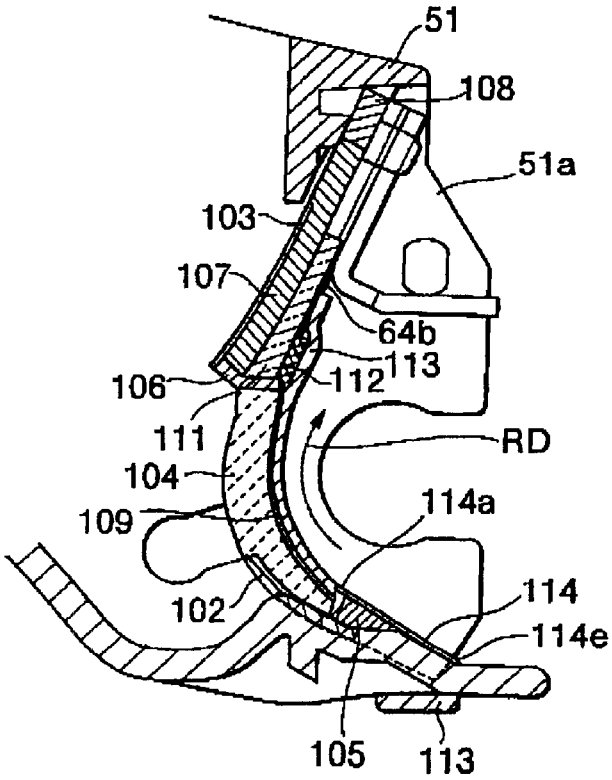
Figure 15:
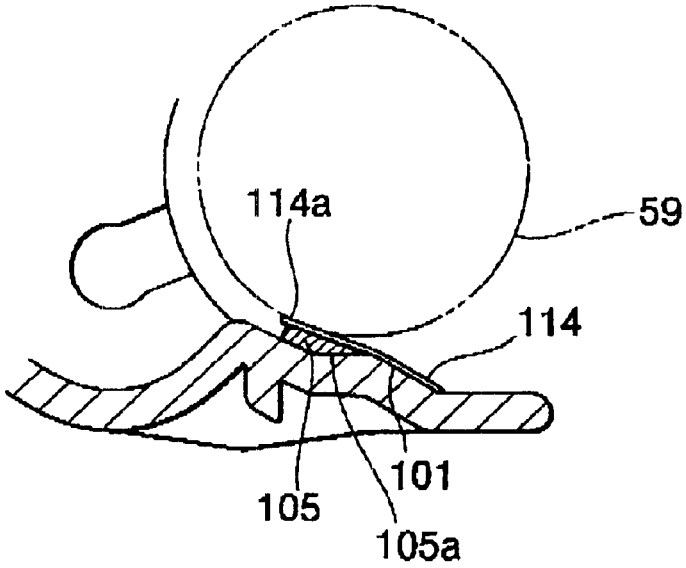
FIG. 15(A) is a cross-sectional view showing configuration according to the present invention for the lower side seal of FIGS. 6(A) to 6(C) and the lower film of FIGS. 14(A) to 14(C)
FIG. 15(B) is a cross-sectional view showing a conceivable configuration for a lower side seal and a lower film.
Figure 15:
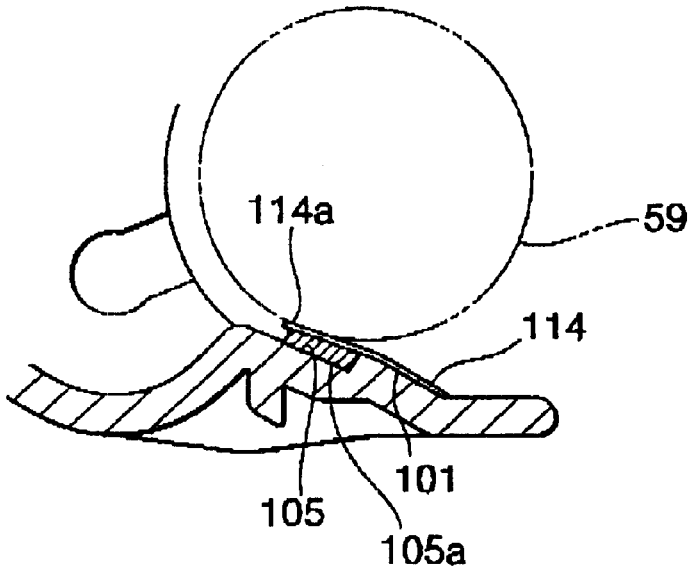

As shown in FIGS. 11, 14(C) and 14(D), the developing unit 50 is provided with seal components 102 to 114 for preventing toner leaks. The seal components 102 to 114 are introduced in the order of assembly in FIGS. 3(A) to 14(D). That is, the side edge seal 102 is shown in FIGS. 3(A) to 3(C), the PET film 103 is shown in FIGS. 4(A) to 4(C), the base seal 104 is shown in FIGS. 5(A) and 4(B), the lower side seal 105 is shown in FIGS. 6(A) to 6(C), the end seal 106 is shown in FIGS. 7(A) and 7(B), the upper side seal 107 is shown in FIGS. 8(A) to 8(C), the upper seal 108 is shown in FIGS. 9(A) and 9(B), the intermediate layer film 109 is shown in FIGS. 10(A) and 10 (B), the side edge seal 110 is shown in FIG. 11, the rear surface blade seals 111 and the front surface blade seals 112 are shown in FIGS. 12(A) to 1(C), the Teflon™ felt contact member 113 is shown in FIGS. 13(A) to 13(D), and the lower film 114 is shown in FIGS. 17(A) to 17(D). To facilitate understanding of the seal components 102 to 114 and how they interrelate, details of the seal components 102 to 114 will be explained along with the procedure for assembling the configuration, with reference to FIGS. 2(A) to 14(D).

The supply roller 58 is housed in the supply roller holding portion as indicated by two dot chain line in FIG. 2(A). The developing roller 59 is disposed in the developing chamber 57 so as to contact the side edge portion 51*a* of the developing case 51, with its rotational axis Q centered as shown in FIG. 2(B).

As indicated by hatching in FIG. 2(A), the inner surface of the developing case 51 includes a side seal attachment region 100 and a lower seal attachment region 101, where seal components are attached to the developing case 51. As shown in FIG. 2(B), the side seal attachment region 100 is formed indented lower than the lower seal attachment region 101. The side seal attachment region 100 and the lower seal attachment region 101 have been subjected to degreasing processes to increase attachment strength of the two-sided tape. The side seal attachment region 100 extends around a portion of the lengthwise end periphery of the developing roller 59 and includes a seal attachment surface 51*x*. The lower seal attachment region 101 extends below the developing roller 59 along a length of the developing roller 59. The seal attaching region 101 is sandwiched between a bottom surface 51*b* and a front edge portion 51*d* of the developing roller holding portion.

The developing case 51 is also formed with a blade attachment surface 51*y*. As shown in FIG. 14(D), the developer layer thickness regulating blade 64 is positioned on the blade attachment surface 51*y* to resiliently press the upper side seal 107 and the rear surface blade seal 111 in the thickness direction of the upper side seal 107 and the rear surface blade seal 111. As shown in FIG. 7(B), the seal attachment surface 51*x* is receded from the blade attachment surface 51*y* in the thickness direction by a step portion E that extends from the seal attachment surface 51x and that, as shown in FIG. 14(D), is located adjacent to ends of the developer layer thickness regulating blade 64 and the rear surface blade seal 111.

As shown in FIGS. 3(A) to 3(C), the side edge seal 102 is attached to the side seal attachment region 100 by two-sided tape. As shown in FIG. 3(A), the side seal attachment region 100 is formed receded lower than the bottom surface 51*b*, thereby forming a step with an edge 51*c*, which defines the border between the side seal attachment region 100 and the lower seal attachment region 101. When attaching the side edge seal 102, the side edge surface of the side edge seal 102 is pressed into intimate contact with the edge 51*c*. The side edge seal 102 is formed from a sponge material that is softer than urethane sponge.

Next, as shown in FIGS. 4(A) to 4(C), the PET film 103 is attached by two-sided tape to the seal attachment surface 51*x*.

Then, as shown in FIGS. 5(A) and 5(B), the base seal 104 is attached by two-sided tape to the side seal attachment region 100 over the side edge seal 102. The base seal 104 has a lower edge 104*a* facing Upstream with respect to rotational direction RD. The base seal 104 is located with its lower edge 104*a* positioned, with respect to rotational direction RD of the developing roller 59, between a free end 114*a* and an adhered portion 114*e* of the lower film 114 in an overlapping condition with the lower film 114. The base seal 104 is formed from a urethane foam, such as Poron$^{RT}$ produced by Rogers Corporation, which is relatively stiff compared to other foam materials. The base seal 104 is formed thick enough so that when the developing roller 59 is attached, the base seal 104 is compressed to produce a predetermined pressing force that presses the Teflon™ felt contact member 113 with a predetermined pressing force against the peripheral surface of the developing roller 59.

As will be described below, the lower side seal 105 of FIGS. 6(A) to 6(C) is adhered on the lower seal attachment region 101 downstream, with respect to rotational direction RD of the developing roller 59, from the adhered portion 114*e* of the lower film 114 as shown in FIG. 14(D). The lower film 114 is then adhered on top of the lower side seal 105 as shown in FIGS. 14(C) and 14(D). As shown in FIGS. 14(A) and 14(E), the lower film 114 has a beveled corner portion 114*b*. When the developing roller 59 is mounted on the case 51, the area around the beveled corner portion 114*b* is sandwiched between the developing roller 59 and the base seal 104. Pressure from the urethane sponge base seal 104 firmly presses the lower film 114 against the developing roller 59. Accordingly, toner can be reliably prevented from leaking from this area.

In addition, because the lower edge 104*a* of the base seal 104 is positioned between the free end 114*a* and the adhered portion 114*e* of the lower film 114, as shown in FIG. 5(A) a side portion 114*c* of the lower film 114 protrudes outward where no base seal 104 is provided underneath. Therefore, the base seal 104 will not press against the side portion 114*c*, so the lower film 114 will not shift out of position by force applied from underneath. As will be described later, according to the present embodiment the felt contact member 113 is attached on the base seal 104. The side portion 114*c* of the lower film 114 contacts the surface of the Teflon™ felt contact member 113, so that when the developing roller 59 is mounted on the case 51, the side portion 114*c* of the lower film 114 is sandwiched between the developing roller 59 and the Teflon™ felt contact member 113. However, even with this configuration, no strong force will develop beneath the side portion 114*c* because the base seal 104 does not exists below the Teflon™ felt contact member 113 at this position. Therefore, the lower film 114 can be prevented from shifting out of position because no particularly strong force is not applied to the lower film 114.

Conventionally, in order to prevent the lower film 114 from being deformed when pressed by the developing roller 59, it was necessary to match the combined thickness of the base seal 104 and the Teflon™ felt contact member 113 with the thickness of the step portion between the lower seal attachment region 101 and the side seal attachment region 100. However, according to the present invention, there is no need to prevent the lower film 114 from deforming by matching these thickness. Therefore, the combined thickness of the base seal 104 and the Teflon™ felt contact member 113 can be made thicker than the thickness of the step portion. As a result, in the region where the base seal 104 exists under the Teflon™ felt contact member 113, the Teflon™ felt contact member 113 and the base seal 104 can be pressed against the developing roller 59 with a greater pressure, thereby enabling prevention of toner leaks even when polymerized toner, which has a high fluidity, is used as the toner.

The following problem would occur if the side edge seal 102 was not provided, then as indicated in dotted line in FIG. 3(B), the base seal 104 would be adhered directly to the side seal attachment region 100, with its edge surface in contact with the edge 51*c*. Because the base seal 104 is made from relatively stiff urethane sponge and the developing case 51 is made from stiff resin, that is because both the base seal 104 and the developing case 51 are relatively stiff, the seal between the base seal 104 and the developing case 51 would be weak. Toner that flows along the bottom surface 51*b* would enter between where the edge 51*c* and the base seal 104 contact each other. Also, the toner from the supply roller holding portion would leak out through this contact portion.

However, because the side edge seal 102 is provided in the present embodiment, a soft sponge is disposed in intimate contact with the stiff resin edge 51*c*. Therefore, toner can be reliably prevented from entering the contact portion between the edge 51*c* and the side edge seal 102. Also, as shown in FIG. 3(A), because the edge surface of the supply roller 58 rubs against the edge surface of the base seal 104, toner is prevented from leaking from between the supply roller 58 and the base seal 104.

Next, as shown in FIGS. 6(A) and 6(B), the lower side seal 105 is attached to the edge of the lower seal attachment region 101 by two-sided tape, in intimate contact with the base seal 104. FIG. 6(C) shows the seals 104, 105 when viewed from the side in a direction indicated by an arrow B in FIG. 6(A). As shown in FIG. 6(C), the lower side seal 105 and the base seal 104 partially overlap by an overlap region W0. In the present embodiment, the overlap region W0 is set to about 2 mm. The lower side seal 105 is formed from an urethane sponge.

The seals 104, 105 form a sponge-to-sponge contact seal between the lower seal attachment region 101 and the side seal attachment region 100. Accordingly, even when the lower side seal 105 and the base seal 104 are compressed when the developing roller 59 is mounted on the case 51, and further even when the lower side seal 105 and the base seal to 104 vibrate in association with rotation of the developing roller 59, a proper seal can be maintained between the two sponge surfaces, so that toner can be reliably prevented from leaking between the lower seal attachment region 101 and the side seal attachment region 100.

Next, as shown in FIGS. 7(A) and 7(B), the end seal 106 is attached on the upper end surface of the base seal 104 and the step portion E by two-sided tape, Then, as shown in FIGS. 8(A) to 8(C), the upper side seal 107 is attached to the developing case 51, both directly and through the PET film 103, by two-sided tape with its end in contact with the end seal 106. The upper side seal 107 is formed from soft urethane sponge. The PET film 103 provides a sufficiently large attachment region for attaching the upper side seal 107. Note that if the upper side seal 107 were adhered only to the developing case 51 without provision of the PET film 103, the adhering region would be only the small region indicated by hatching in FIG. 4(B).

Next, as shown in FIGS. 9(A) and 9(B), the upper seal 108 is attached to the developing case 51 above the upper side seal 107. The upper seal 108 is formed from soft urethane sponge in an elongated shape. As shown in FIG. 14(D), the upper seal 108 contacts the rear surface of the layer thickness regulating blade 64, once the layer thickness regulating blade 64 is attached to the developing case 51. With this configuration, even when toner clouds up within the toner holding chamber 52, the upper seal 108 will prevent the toner from leaking. The upper seal 108 also prevents toner from leaking when the developing unit 50 is turned upside down.

Next, as shown in FIGS. 10(A) and 10(B), the intermediate layer film 109 is attached to the base seal 104 by two-sided tape. The intermediate layer film 109 is formed from PET film. As shown in FIG. 10(A), the intermediate layer film 109 is wider than the base seal 104 in directions indicated by arrows X in FIG. 10(A), which will be referred to as directions X hereinafter. One edge of the intermediate layer film 109 protrudes toward the center of the developing case 51, and serves as a partial barrier between the toner in the developing chamber 57 and the contact position where the developing roller 59 and the Teflon™ felt contact member 113 contact each other. The intermediate layer film 109 disperses pressure of the toner against the contact position, so that toner leaks can be reliably prevented without having to press the base seal 104 too forcefully against the developing roller 59.

Also, the inward-protruding edge of the intermediate layer film 109 is cut at sections 109*a* from the center side of the developing case 51 in the direction X. This prevents the intermediate layer film 109 from tearing because of deformation caused by load in association with rotation of the developing roller 59 and the supply roller 58.

Next, as shown in FIG. 11, the side edge seal 110 is attached to the upper portion of the intermediate layer film 109 by two-sided tape. The side edge seal 110 is formed from sponge and prevents a gap from opening between the plate spring 64*b* and the intermediate layer film 109 so that toner leaks can be prevented.

Next, configuration of the layer thickness regulating blade 64 will be described while referring to FIGS. 12(A) to 12(C). As mentioned previously, the layer thickness regulating blade 64 faces the developing roller 59. The surface of the layer thickness regulating blade 64 that faces the developing roller 59 will be referred to as the front surface, and the surface of the layer thickness regulating blade 64 that faces away from the developing roller 59 will be referred to as the rear surface, hereinafter.

The layer thickness regulating blade 64 includes a support portion 64*c*, a plate spring 64*b*, and a pressing member 64*a*. The layer thickness regulating blade 64 further includes front surface blade seals 112 and rear surface blade seals 111 for preventing toner from leaking around the ends of the layer thickness regulating blade 64.

The support portion 64*c* is formed from iron or stainless steel to a length L1 in directions X. The support portion 64*c* is formed near its edges with boss holes 115 and screw holes 116. The plate spring 64*b* is a thin plate formed from phosphor bronze or stainless steel, for example, and is attached to the support portion 64*c*. The plate spring 64*b* has the same length L1 in the direction X and a height H2 in a direction Y. The pressing member 64*a* is formed from a silicon rubber that has conductivity to a length L2 that is shorter than the length L1. Said differently, the plate spring 64*b* extends in the lengthwise direction of the developing roller to a longer length L1 than the length L2 of the pressing member 64*a*. The pressing member 64*a* is attached to the front surface of the plate spring 64*b*, centered along the directions X of the plate spring 64*b*, thereby leaving end portions of the plate spring 64*b* uncovered by the pressing member 64*a*. With this configuration, the plate spring 64*b* has exposed portions near its ends where the pressing member 64*a* is not provided. The exposed portions each have a width W2 in the direction X.

Both the rear surface blade seal 111 and the front surface resilient foam seal 112 are made from a sponge material that is softer than the urethane sponge. As shown in FIG. 12(A), one rear surface blade seal 111 is attached by two-sided tape near each end of the plate spring 64*b*, on the rear surface of the plate spring 64*b*. Each rear surface blade seal 111 has a width W1 in the directions X, which is wider than the width W2 of the exposed portions of the plate spring 64*b*. As a result, each rear surface blade seal 111 covers a region in the directions X on the rear surface of is the plate spring 64*b*, that corresponds to one of the exposed regions on the front surface of the plate spring 64*b*. The rear surface blade seal 111 is formed in the direction Y to a height H1, which is greater than the height H2 of the plate spring 64*b*.

As shown in FIG. 12(B), one front surface resilient foam seal 112 is attached to each exposed portion of the plate spring 64*b* by two-sided tape, so that the pressing member 64*a* is sandwiched between the front surface blade seals 112.

Then, as shown in FIG. 12(C) the layer thickness regulating blade 64 is attached to the developing case 51 so that the rear surface blade seal 111 pressingly contacts the upper side seal 107. Also, the lower surface of the rear surface blade seal 111 contacts the side edge seal 106.

As shown in FIG. 13(C), the plate spring 64*b* receives pressing force from the upper side seal 107 and the rear surface blade seal 111 in the direction F. However, the plate spring 64*b* will not bend under this pressing force, because the rear surface blade seals 111 are formed to the width W1 and are therefore wider than the width W2 of the exposed portions of the plate spring 64*b*. That is, because the rear surface blade seal 111 is wider than the exposed portion, they each cover a region wider than a region that corresponds to the exposed portions in the direction X. Therefore, the upper side seal 107 and the rear surface blade seal 111 press not only the plate spring 64*b*, but also the pressing member 64*a*, so that the plate spring 64*b* will not bend. As a result, toner leaks caused by the plate spring 64*b* bending can be prevented.

The silicon rubber that forms the pressing member 64*a* can wear down over long periods of use. However, as shown in FIG. 13(D), the combined thickness of the front surface resilient foam seal 112 and the Teflon™ felt contact member 113 is formed thicker than the thickness of the pressing member 64*a*. With this configuration, when the pressing member 64*a* is worn down by a certain amount, the plate spring 64*b* will compress the front surface resilient foam seal 112 by an equivalent amount. Therefore, the pressing member 64*a* will press against the developing roller 59 by a constant strength, so that the toner can be reliably prevented from leaking at the contact portion between the pressing member 64*a* and the developing roller 59.

As shown in FIGS. 13(A) to 13(C), the Teflon™ felt contact members 113 are attached by two-sided tape to the plate spring 64*b*, the front surface resilient foam seal 112, the intermediate layer film 109, and the side seal attachment region 100. As shown in FIG. 13(B) and 13(C), the leading edge of the Teflon™ felt contact member 113 is attached to the front surface of the plate spring 64*b*. Then, the following portion of the Teflon™ felt contact member 113 is attached to cover the front surface resilient foam seal 112, the intermediate layer film 109, and the side seal attachment region 100. With this configuration, toner can be reliably prevented from leaking from both ends of the pressing member 64*a*. Because the Teflon™ felt contact member 113 moves in accordance with movement of the metal plate 64*b* of the layer thickness regulating blade 64, the Teflon™ felt contact member 113 can reliably prevent toner from leaking and also does not interfere with movement of the metal plate 64*b* of the layer thickness regulating blade 64. The Teflon™ felt contact member 113 has a low friction resistance with respect to the developing roller 59 so that rotational torque required to rotate the developing roller 59 can be reduced.

Next, the lower film 114 is attached as shown in FIGS. 14(A) to 14(D). When the developing roller 59 is installed, the lower film 114 will be in sliding contact along a length of the developing roller 59. "A length" in this case means a portion or all of surface of the developing roller 59 in the lengthwise direction of the developing roller 59. The lower film 114 can be formed from either PET sheet or urethane rubber film. The urethane rubber film has a sufficiently soft touch but has poor stiffness. Therefore, it is necessary to press the rear surface of the urethane rubber film with a sponge for example. On the other hand, PET sheet is stiffer than the urethane film, so there is no need to press the PET sheet from behind. Also, the PET sheet is easier to use during assembly operations than is urethane rubber film. The lower film 114 is formed from the PET sheet in the present embodiment. As shown in FIG. 14(B), the lower film 114 is attached to a portion of the lower seal attachment region 101, a portion of the front edge portion 51*d* of the developing case 51, and a portion of the lower side seal 105 by two-sided tape. The portion of the front edge portion 51*d* covered by the lower film 114 has a width W3 in the direction X and a height H3 in the direction Y. Because the lower film 114 is adhered not only to the lower seal attachment region 101, but also to the portion of the front edge portion 51*d*, the lower film 114 is not easily peeled off even if the pressing force of the developing roller 59, the lower film 114, and the Teflon™ felt contact member 113 is increased to a certain amount.

As shown in FIGS. 14(A) to 14(C), the corner portion 114*b* of the lower film 114 overlaps the Teflon™ felt contact member 113. When the developing roller 59 is mounted into the case 51, the corner portion 114*b* of the lower film 114 is pressed against the Teflon™ felt contact member 113 by the developing roller 59. This eliminates any gap between the free end 114*a* of the lower film 114 and the Teflon™ felt contact member 113. Accordingly, the free portion 114*d* of the lower film 114 can be properly pressed in contact with the developing roller 59. Accordingly, toner can be reliably prevented from leaking between where the developing roller 59 and the lower film 114 contact each other.

As shown in FIG. 14(D), the base seal 104 is not disposed upstream, in the rotational direction RD of the developing roller 59, from where the lower film 114 contacts the Teflon™ felt contact member 113. Therefore, a force strong enough to deform or positionally shift the lower film 114 will not be generated even when the developing roller 59 is mounted in the case. Accordingly, toner will not leak by the lower film 114 because it deforms or shifts out of position.

As shown in FIGS. 14(A) and 14(B), the corner portion 114*b* sandwiched between the lower film 114 and the Teflon™ felt contact member 113 is beveled into a rounded shape. The developing roller 59 according to the present embodiment is made from a resilient conductive roller as described above. Such a developing roller is easily scratched in lines along the roller surface where contacted by a corner portion of a seal member. Toner can accumulate in damaged portions of the developing roller 59, and leak as a result. Silicon and the like enter into the line-shaped scratches, which further increases the size of the scratches so that toner leak through the scratches.

However, according to the present embodiment, the corner portion 114*b* of the lower film 114 is beveled into a curved shape, the rounded surface will not damage the developing roller 59, even if a conductive resilient roller is used as the developing roller 59. Therefore, toner can be reliably prevented from leaking because the roller surface will not be damaged.

The lower film 114 is attached not only to the lower seal attachment region 101 but also to the lower side seal 105. Therefore, even if the lower film 114 vibrates in association with rotation of the developing roller 59, a proper seal can be maintained at the interface between the lower side seal 105 and the lower film 114. Accordingly, toner can be reliably prevented from leaking even when polymerized toner is used as toner.

As shown in FIG. 15(A), the lower seal attachment region 101 is formed with a lower side seal attachment region 105*a* that slants at a predetermined angle. Therefore, as shown in FIG. 15(A), when the lower film 114 is attached, the lower side seal 105 is compressed into a wedge shape.

In contrast to this, as shown in the comparative example in FIG. 15(B), the lower seal attachment region 101 and the attachment region 105*a* of the side seal 105 are formed substantially in parallel, so that a step indicated by an arrow in FIG. 15(B) is formed at the boundary between the attachment regions 101, 105*a*. A resin-sponge interface between the case and the side seal 105 results. When the lower side seal 105 vibrates in association with rotation of the developing roller 59, the poor seal at the resin-sponge interface cannot prevent toner from leaking.

However, according to the present embodiment, as shown in FIG. 15(A), the lower side seal 105 deforms into a wedge shape so no such resin-sponge interface is generated. Accordingly, even polymerized toner is reliably prevented from leaking.

By applying the present invention to a developing cartridge or process cartridge, toner can be reliably prevented from leaking at the time of replacement. Even when the image forming device 1 is a non-portable desk top printer, toner will not stain the inside of the image forming device 1 even if the laser beam printer 1 is vibrated or moved around.

Next, a developing unit according to a second embodiment of the present invention will be described. It should be noted that components common to the first embodiment and the second embodiment will be assigned with the same numbering and their explanation will be omitted.

Figure 16:
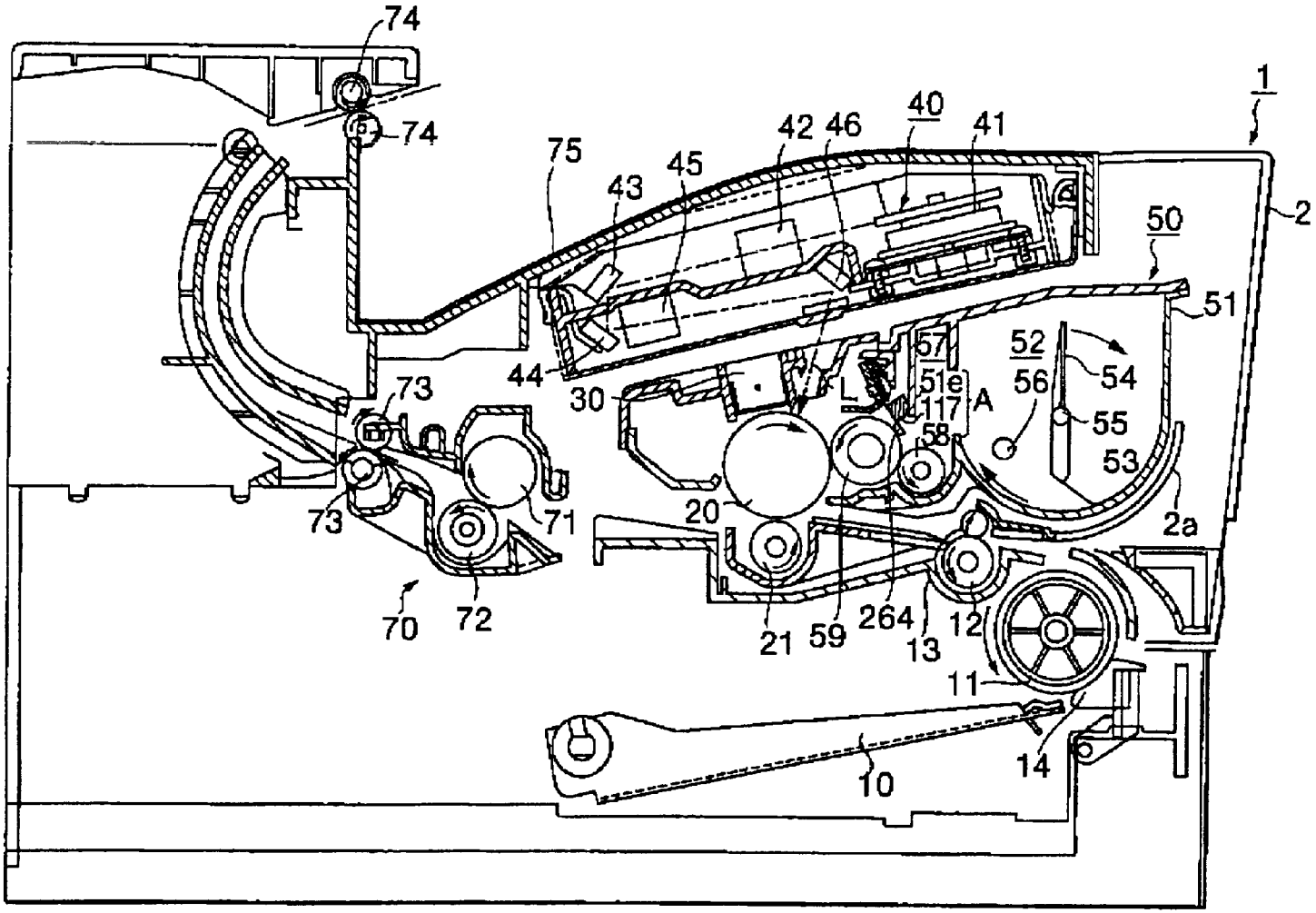
FIG. 16 is a cross-sectional view showing configuration of an image forming device according to a second embodiment of the present invention.
Figure 17:
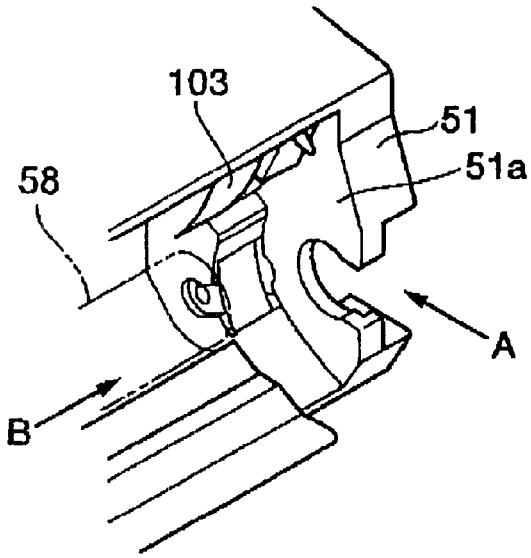
FIG. 17(A) is a partial perspective view showing a developing unit case of FIG. 16 after a PET film has been attached.
FIG. 17(B) is a cross-sectional view showing the developing case and seal configuration as viewed from the direction indicated by an arrow B in FIG. 17(A)
Figure 17:
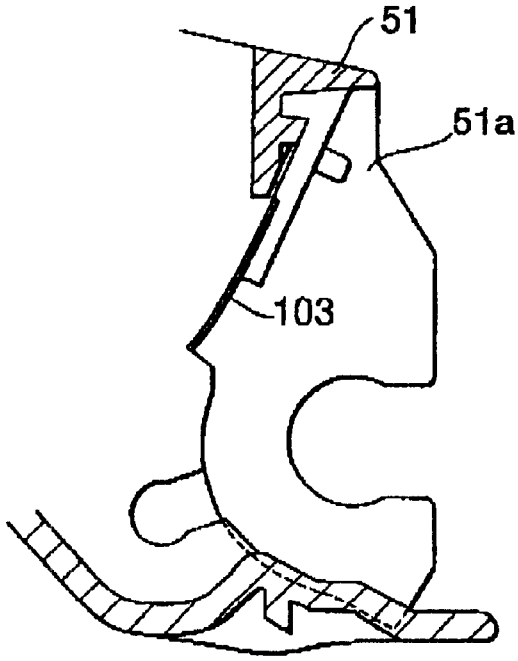

As shown in FIG. 16, the developing unit of the second embodiment can be included in the same laser printer 1 as the first embodiment. The developing unit according to the present embodiment includes a rib 51*e* and a layer thickness regulating blade 264. The rib 51*e* is provided behind the layer thickness regulating blade 264 in the developing chamber 57 of the case 51. The layer thickness regulating blade 264 has a configuration similar to that of the layer thickness regulating blade 64 of the first embodiment. However, the layer thickness regulating blade 264 has a rib sponge 117 that presses against the rib 51*e*. As shown in FIGS. 22(A) to 22(D), the rib sponge 117 is attached by two-sided tape to the rear surface of the plate spring 64*b* in a region between the two rear surface blade side seal 111 so as to extend in the X direction. The rib sponge 117 is formed from urethane sponge to thicker than the rear surface blade side seal 111.

Figure 18:
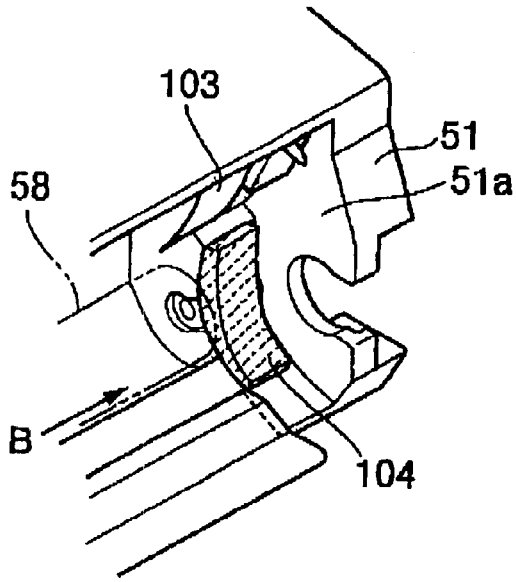
FIG. 18(A) is a partial perspective view showing the developing unit case of FIG. 16 after a side seal has been attached.
FIG. 18(B) is a cross-sectional view showing the developing case and seal configuration as viewed from the direction indicated by an arrow B in FIG. 18(A)
Figure 18:
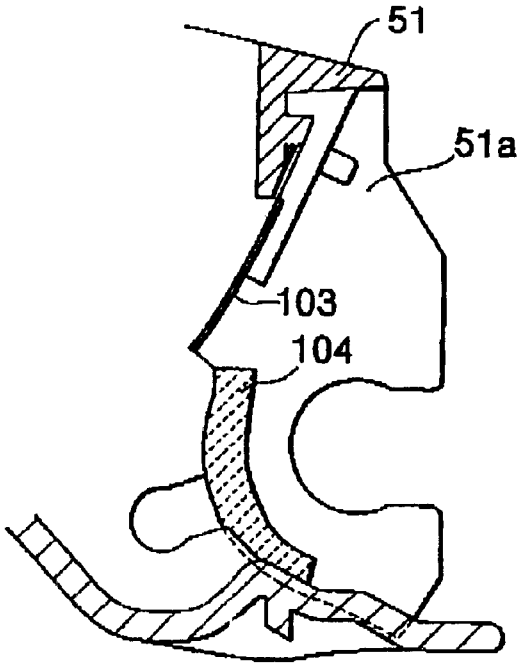
Figure 19:
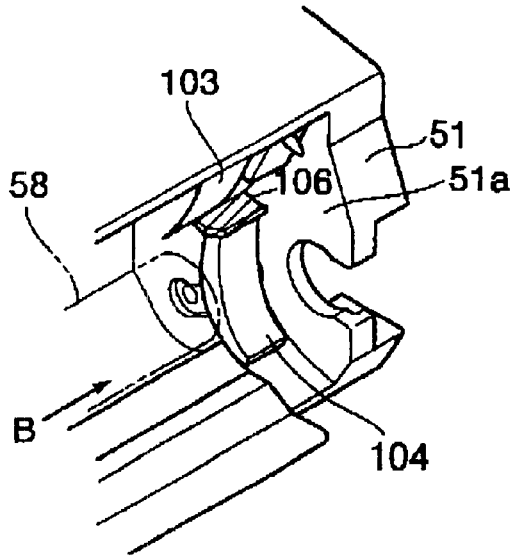
FIG. 19(A) is a partial perspective view showing the developing case after an end seal has been attached.
FIG. 19(B) is a cross-sectional view showing the developing case and seal configuration viewed from the direction indicated by an arrow B in FIG. 19(A)
Figure 19:
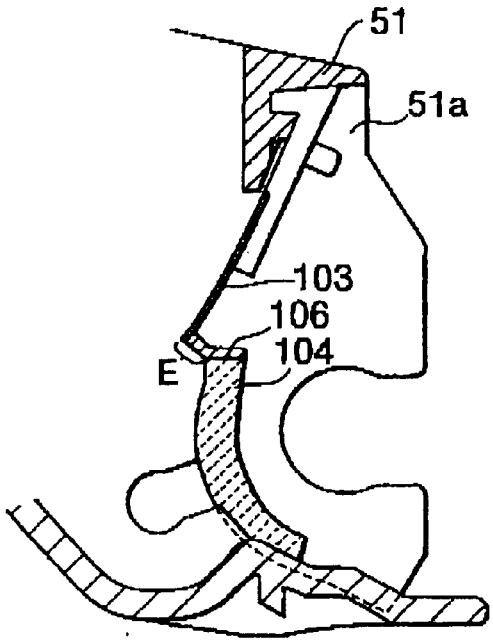
Figure 20:
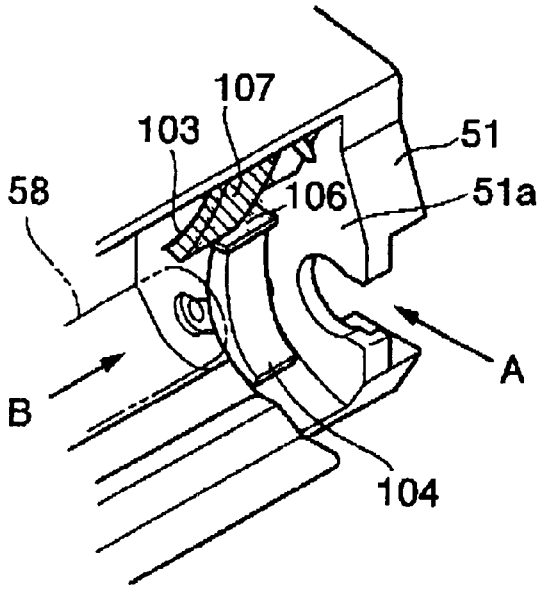
FIG. 20(A) is a partial perspective view showing the developing case after an upper side seal has been attached.
FIG. 20(B) is a cross-sectional view showing the developing case and seal configuration as viewed in the direction indicated by an arrow B in FIG. 20(A)
Figure 20:
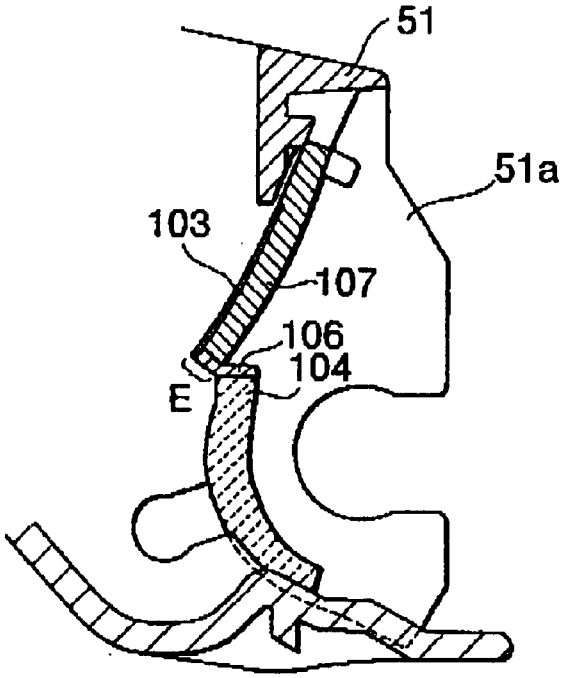
Figure 21:
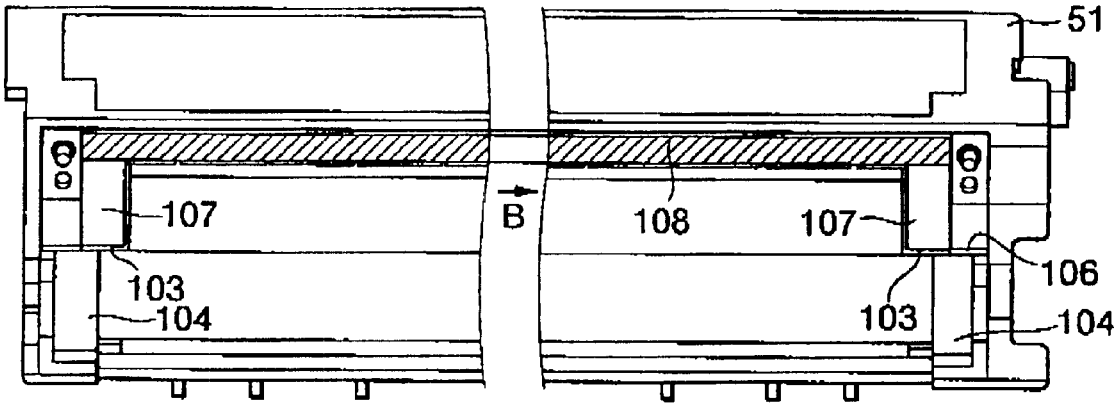
FIG. 21(A) is a front view showing the developing case after an upper seal has been attached.
FIG. 21(B) is a cross-sectional view showing seal configuration as viewed from the direction indicated by an arrow B in FIG. 21(A)
Figure 21:
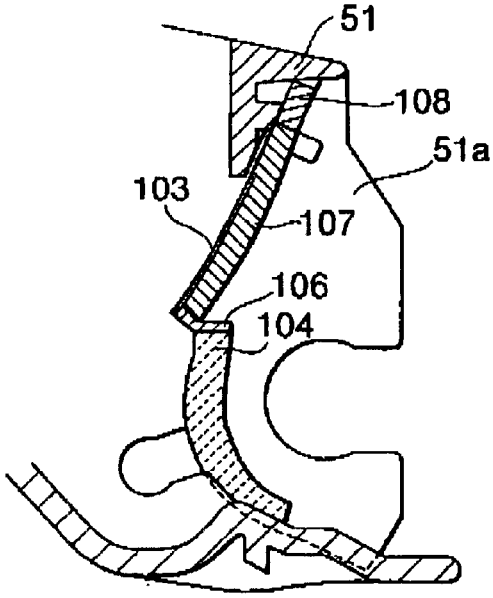

Other seal components 103 to 108, 113, and 214 are also provided near the ends of the layer thickness regulating blade 264 for preventing toner leaks. As shown in FIGS. 17(A) to 21(B), the seal components 103, 104, and 106 to 108 are attached in the same manner and order as in the above-described first embodiment, except that no side edge seal 102 is used in the present embodiment, so the base seal 104 is directly attached to the case 51 as shown in FIGS. 18(A) and 18(B).

Figure 22:
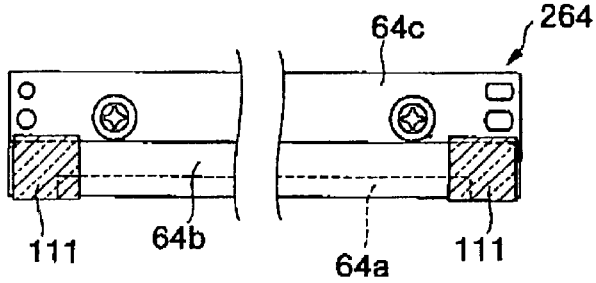
FIG. 22(A) is a plan view of a rear surface of a layer thickness regulating blade according to the second embodiment.
FIG. 22(B) is a plan view of the rear front surface of the layer thickness regulating blade with a rib sponge attached thereto.
FIG. 22(C) is a plan view of a front surface of the layer thickness regulating blade of FIG. 22(A)
FIG. 22(D) is a cross-sectional view showing the layer thickness regulating blade attached in the developing unit case.
Figure 22:
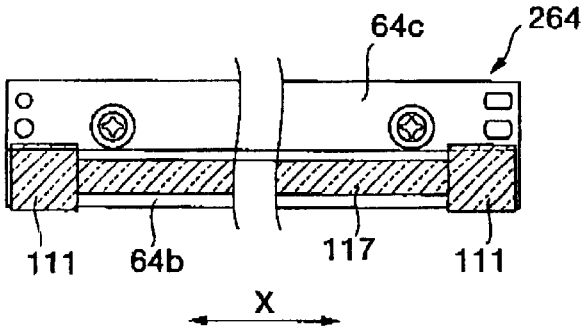
Figure 22:
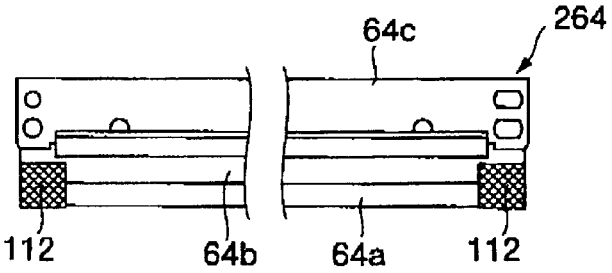
Figure 22:
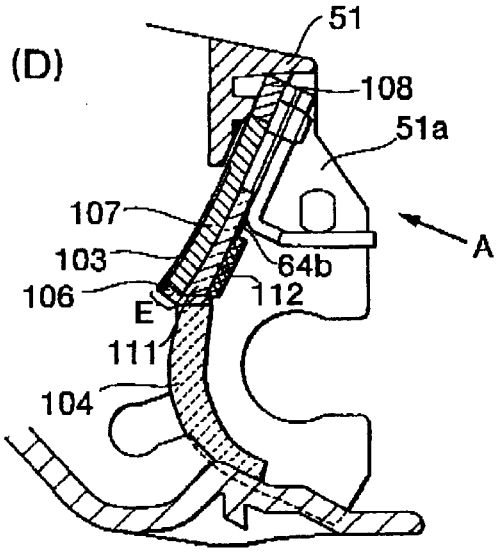

Next, the layer thickness regulating blade 264 is attached to the case 51 as shown in FIG. 22(D). At this time, the rib sponge 117 presses against the rib 51*e*. With this configuration, toner can be prevented from entering behind the layer thickness regulating blade 264 and uncharged toner can be prevented from accumulating on the rear surface of the layer thickness regulating blade 264. As a result, uncharged toner will not fall off the rear surface of the layer thickness regulating blade 264 so that fogging can be prevented.

Figure 23:
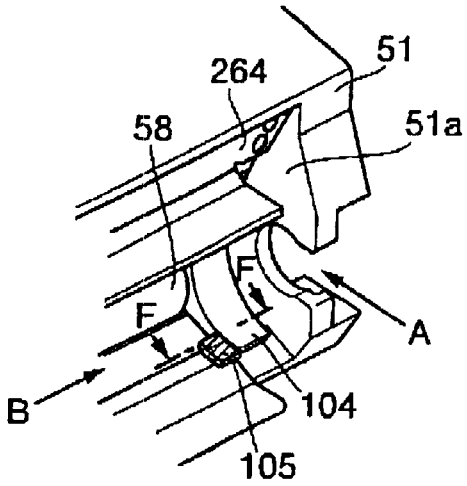
FIG. 23(A) is a partial perspective view showing the developing unit case of FIG. 16 after a lower side seal has been attached.
FIG. 23(B) is a cross-sectional view taken along a line F—F of FIG. 23(A)
FIG. 23(C) is a cross-sectional view showing the developing case and seal configuration as viewed in the direction indicated by an arrow B in FIG. 23(A)
Figure 23:
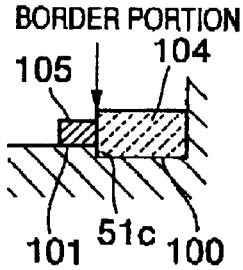
Figure 23:
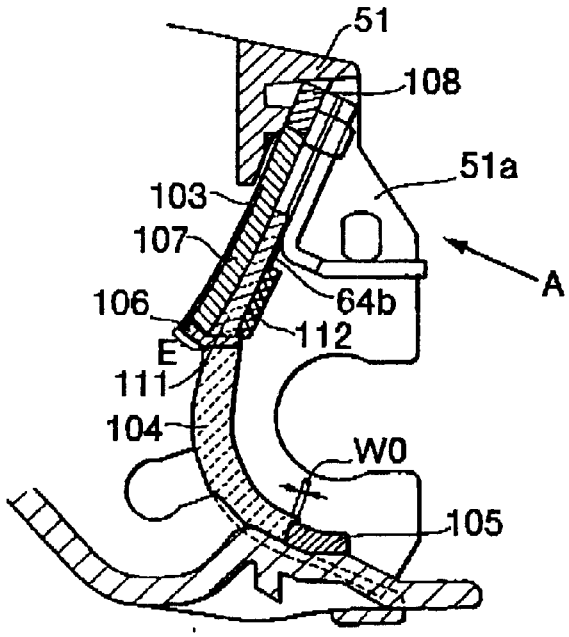

Next, as shown in FIGS. 23(A) to 23(C), the lower side seal 105 is attached in the same manner as in the first embodiment.

Next, as shown in FIGS. 24(A) to 24(D), a Teflon™ felt contact member 113 is attached using two-sided tape across the plate spring 64*b* of the layer thickness regulating blade 264, the front surface resilient foam seal 112, and the side seal attachment region 100. The top end of the Teflon™ felt contact member 113 is attached to the plate spring 64*b*, then attached consecutively to cover the front surface resilient foam seal 112. With this configuration, toner can be reliably prevented from leaking from ends of the pressing members 64*a* of the layer thickness regulating blade 264.

Figure 25:
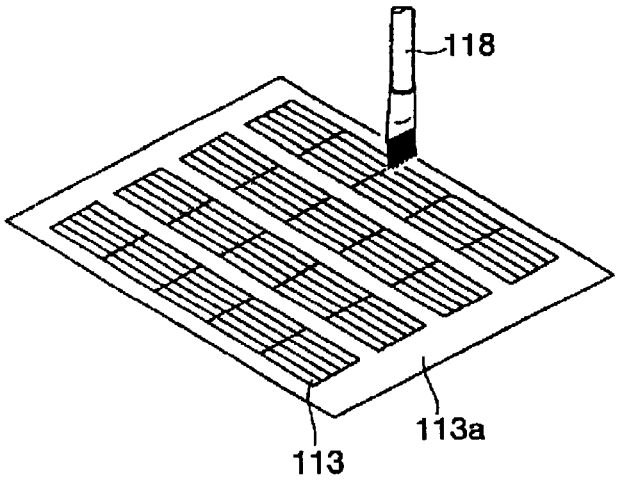
FIG. 25 is perspective view of the Teflon™ felt contact member of FIG. 24(A) being prepared from a Teflon™ felt sheet coated with lubricant using a brush.

Here, explanation will be provided for producing the Teflon™ felt contact member 113. As shown in FIG. 25, a Teflon™ felt sheet 113*a* is coated with lubricant using a brush 118. The lubricant includes a fluorine resin and a fluoride oil dispersed in quick drying resin. After coating the Teflon™ felt sheet 113*a* with the lubricant, the Teflon™ felt sheet 113*a* is cut into strips as indicated by lines in FIG. 25. Each strip forms a Teflon™ felt contact member 113. The Teflon™ felt contact members 113, when attached as described above, not only prevent toner from leaking where the developing roller 59 and the Teflon™ felt contact member 113 slide against each other, but also improve lubrication so that no undesirable noise will be generated even when the developing roller 59 is driven to rotate.

In this embodiment, HANARL FL-Z75, produced by Kanto Kasei Ltd., was used as lubricant, and coated by 20 g +/−5 g on each 100 Teflon™ felt contact member 113. HANARL FL-Z75 includes 80% to 90% by weight of hydrofluorocarbon as a volatile solvent and further includes about 10% to 20% by weight of polytetrafluoroethylene (PTFE) as the fluorine oil and fluorine resin, and other components.

Figure 24:
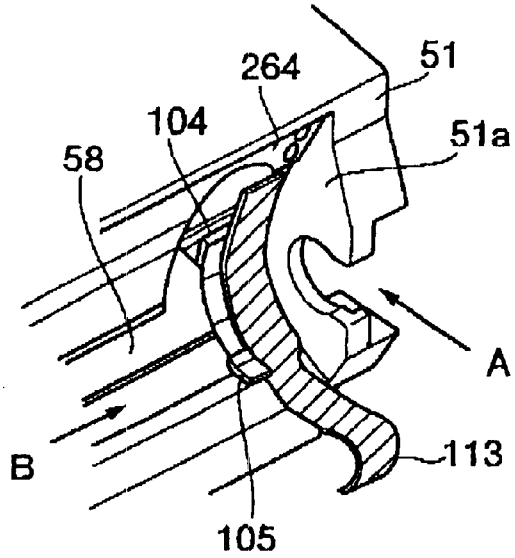
FIG. 24(A) is a partial perspective view showing the developing unit case of FIG. 16 after a Teflon™ felt contact member has been attached.
FIG. 24(B) is a plan view showing the seal configuration as viewed from a direction indicated by an arrow A in FIG. 24(A)
FIG. 24(C) is a cross-sectional view showing the developing case and the seal configuration as viewed from the direction indicated by an arrow B in FIG. 24(A)
FIG. 24(D) is a cross-sectional view taken along the line D—D in FIG. 24(C)
Figure 24:
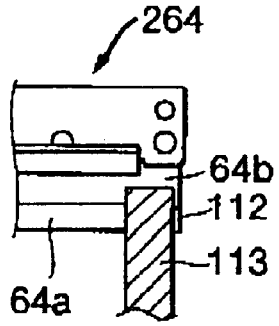
Figure 24:
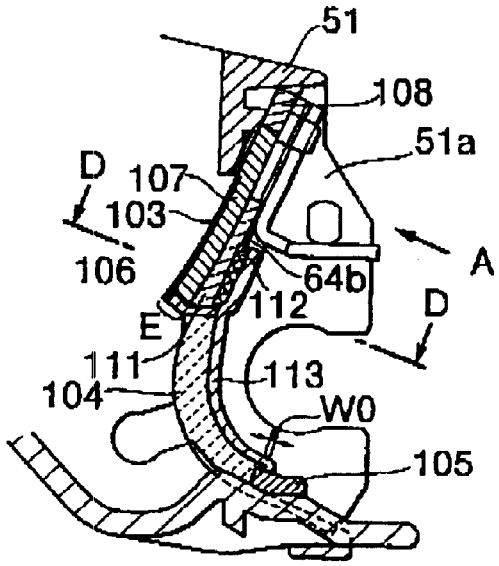
Figure 24:
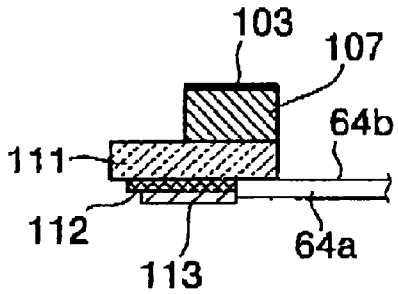

As shown in FIGS. 24(B) to 24(D), the Teflon™ felt contact member 113 is positioned to the side of the pressing member 64*a*, and overlaps over the plate spring 64*b* Therefore, the fibers of the Teflon™ felt contact member 113 will not enter between the pressing member 64*a* and the developing roller 59 Therefore, no gap will form between the pressing member 64*a* and the developing roller 59. As a result, toner can be reliably prevented from leaking between the pressing member 64*a* and the developing roller 59. Further, by extending the Teflon™ felt contact member 113 over the plate spring 64*b*, the Teflon™ felt contact member 113 moves in association with movement of the plate spring 64*b*. Therefore, movement of the plate spring 64*b* will not be interfered with. Further, as shown in FIGS. 24(C) and 24(D), the front surface resilient foam seal 112 is interposed between and adhered to the plate spring 64*b* and the Teflon™ felt contact member 113 by two-sided tape. As a result, even when the developing roller 59 is pressed with sufficient force against the Teflon™ felt contact member 113 to reliably prevent toner from leaking around the ends of the developing roller 59, the front surface resilient foam seal 112 will be compressed by an appropriate amount to absorb this force, so that pressing force of the pressing member 64*a* against the developing roller 59 will not weaken at ends of the developing roller 59.

Figure 26:
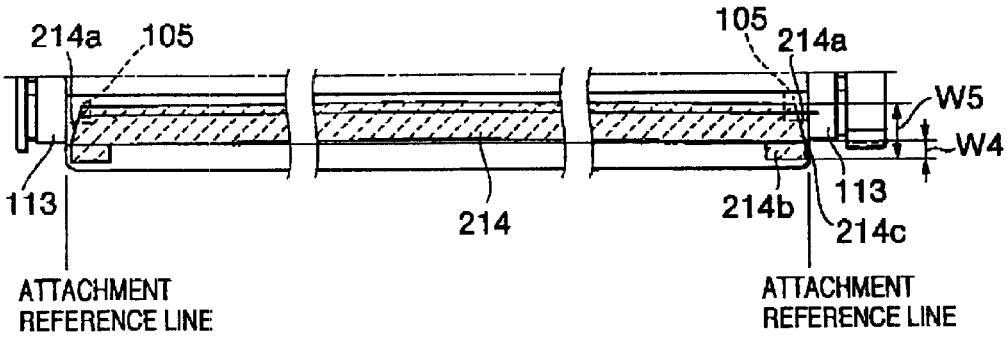
FIG. 26(A) is a plan view showing the developing unit case of FIG. 16 attached with a lower film according to the second embodiment.
FIG. 26(B) is a perspective view showing the developing unit case of FIG. 16 attached with the lower film of FIG. 26(A)
Figure 26:
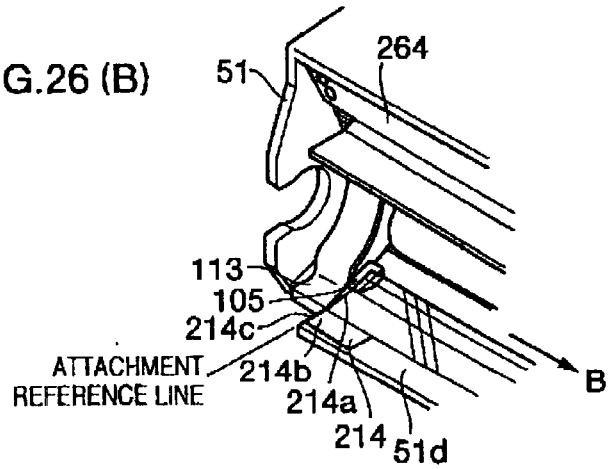

Next, the lower film 214 is attached as shown in FIGS. 26(A) and 26(B). The lower film 214 can be formed from either PET sheet or urethane rubber film. The lower film 214 is formed from the PET sheet in the present embodiment. Each lengthwise end of the lower film 214 is formed with an exposure edge 214*a* and an attachment reference edge 214*c*. The attachment reference edges 214*c* each correspond to an attachment reference area 214*b*, and each have a width W4. The exposure edges 214*a* are formed with a slant with respect to attachment reference lines between the side seal attachment regions 100 and the lower seal attachment region 101. On the other hand, the attachment reference edges 214*c* are formed substantially parallel with the attachment reference lines.

The lower film 214 is attached to a portion of the lower seal attachment region 101, a portion of the front edge portion 51*d* of the developing case 51, and a portion of the lower side seal 105 by two-sided tape. Because the lower film 214 is adhered not only to the lower seal attachment region 101, but also to the portion of the front edge portion 51*d*, the lower film 214 is not easily peeled off even if the pressing force of the developing roller 59, the lower film 214, and the Teflon™ felt contact member 113 is increased to a certain amount.

Because the lower film 214 is formed with exposure edges 214*a* that slant with respect to the attachment reference line, a space, or gap, is formed between the exposure edge 214*a* and the Teflon™ felt contact member 113 so that the lower side seal 105 is exposed through the space. Since the lower film 214 does not overlap with the Teflon™ felt contact member 113, no step equivalent to the thickness of the lower film 214 will form between the lower film 214 and the Teflon™ felt contact member 113. Thus, no gap will form between the developing roller 59 and the Teflon™ felt contact member 113 by the thickness of the lower film 214. Therefore, because the Teflon™ felt contact member 113 does not contact the lower film 214, toner can be reliably prevented from leaking.

The lower film 214 is positioned with the exposure edge 214*a* partially overlapping with the lower side seal 105. Therefore, when the lower film 214 is adhered in place, the overlapping portion will press down on the lower side seal 105, thereby compressing this portion of the lower side seal 105 by a certain amount. On the other hand, the non-overlapping portion of the lower side seal 105, which is exposed through the gap between the exposure edge 214*a* and the Teflon™ felt contact member 213, is not compressed, and so rises up higher than the surface of the lower film 214 because of resilient force of the urethane sponge material forming the lower side seal 105. When the developing roller 59 is mounted into the case 51, the peripheral ends of the developing roller 59 are brought into intimate contact with the Teflon™ felt contact members 113 by the resilient force of the base seal 104, and also with the lower side seals 105 through the gaps between the exposure edges 214*a* and the Teflon™ felt contact members 113. The developing roller 59 is in intimate contact with the movable free edge of the lower film 214 across its entire length. With this configuration, a seal member contacts the developing roller 59 across its entire length without any gaps so that toner can be reliably prevented from leaking.

By forming the exposure edges 214*a* of the lower film 214 at a slant as described above, the attachment reference edges 214*c* of the attachment reference area 214*b* have a relatively short width W4 as shown in FIG. 26(A). Therefore, the lower film 214 is easier to attach. That is, if both end edges of the lower film 214 were formed perpendicular to the long side of the film 124, then the attachment reference edge 214*c* would have the W5 shown in FIG. 26(A). In this case, it would be very difficult to attach both edges of the lower film 214 aligned with the attachment reference edge 214*c* within a predetermined tolerance across the entire large width W5. Therefore, it is likely that some portion of the long attachment reference edges of the lower film 214 would cross over the attachment reference lines, so that the edges of the lower film 214 accidentally overlap the Teflon™ felt contact member 113. Even if the assembler manages to successfully attach the lower film 214 with the long edges aligned with the attachment reference line, it would be a time consuming task, which raises the probability that the operator accidentally wrinkles or bends the elongated lower film 214 at its center portion. However, according to the present embodiment, the attachment reference edges of the lower film 214 are quite short, so both attachment reference edges 214*c* of the lower film 214 can be easily attached with respect to the attachment reference line within a predetermined reference tolerance.

As described above, the developing device according to the present embodiment has improved operability and can reliably prevent toner from leaking from above and below the developing roller 59, and from around the ends of the developing roller 59.

If the end edges of the lower film were merely straight, that is, without being cut, then the lower side seal 105 would deform when pressed by the lower film. A gap would open up between the base seal 104 and the lower side seal 105, and toner would leak through the gap. However, because the edges 214*a* of lower film 214 are cut with a slant, the force that the lower film 214 presses against the lower side seal 105 is reduced, so that no gap will open up and no toner will leak.

It should be noted that the lengthwise ends of the lower film can be formed to any shape that forms a gap between the edge 314*a* and the Teflon™ felt contact member 113 for exposing the lower side seal 105.

Figure 27:
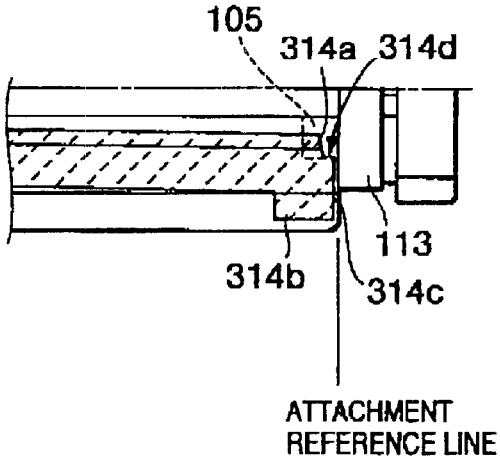
FIG. 27 is a plan view showing a lower film according to a third embodiment.

For example, as shown in FIG. 27, each lengthwise end of a lower film 314 of a third embodiment has an exposure edge 314*a*, a step portion 314*d*, and an attachment reference edge 314*c*. The step portion 314*d* produces a gap between the exposure edge 314*a* and the Teflon™ felt contact member 113, thereby exposing the lower side seal 105. The attachment reference edges 314*c* are longer than the attachment reference edges 214*c* of the second embodiment. The step portion 314*d* also facilitates operations for attaching the lower film 314. Also, by providing the step portion 314*d*, for example by cutting the edge of the lower film 314, the ends of the lower film 314 will never ride up over the base seal 104, so toner leaks can be prevented.

Next, a fourth embodiment of the present invention will be described while referring to FIG. 28. It should be noted that common components between the second and the fourth embodiment will be provided with the same numbering and their explanation will be omitted.

Figure 28:
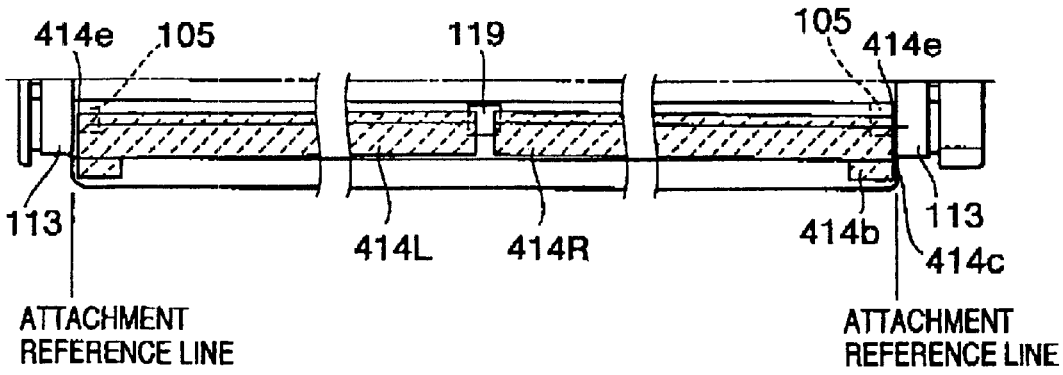
FIG. 28 is a plan view showing a lower film according to a fourth embodiment.

As shown in FIG. 28, the lower film 414 according to the fourth embodiment differs from the lower film 214 of the second embodiment in that the lower film 414 is divided into a right lower film 414R and a left lower film 414L. Each of the right and left lower films 414R, 414L have edge portions 414*e* defined between right angles. Further, the right and left lower films 414R, 414L are separated where they face each other by a predetermined gap. A center seal 119, which is similar to the lower side seal 105, is attached to the lower seal attaching region 101 at a position below the right and left lower films 414R, 414L at this predetermined gap.

By dividing the lower film 414 into two separate parts, each of the right and left lower films 414R, 414L are shorter than the lower film 214 of the second embodiment so that the lower film 414 can be more easily attached. Accordingly, as shown in FIG. 28, the edge portions 414*e* of the lower film 414 can be defined by right angles so the attachment reference edge 414*c* can be aligned in parallel with the attachment reference line. Any error in position where the lower film 414 is attached is absorbed by the predetermined gap in between the two lower film 414R, 414L.

As described above, according to the second to fourth embodiments of the present invention, the lower film can be more easily attached and toner between the lower film and the Teflon™ felt or the side seals can be effectively prevented from leaking.

Figure 29:
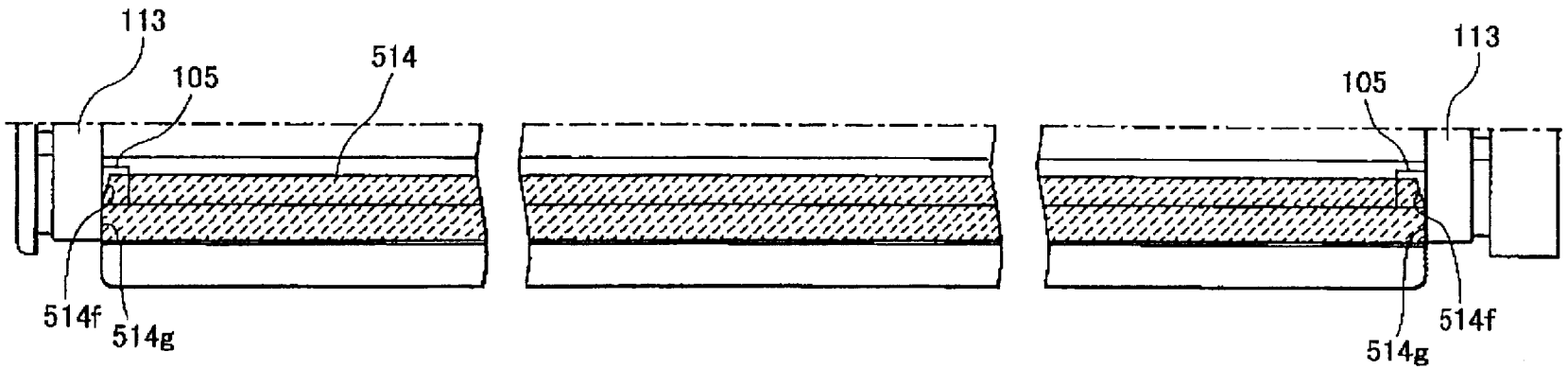
FIG. 29 is a plan view showing a lower film according to a fifth embodiment.

Next, a fifth embodiment of the present invention will be described while referring FIGS. 29 to 34. The fifth embodiment is similar to the second embodiment, except that the lower film 214 is replaced with a lower film 514. As shown in FIG. 29, the lower film 514 includes at each lengthwise end thereof a slanted edge 514*f* and a straight edge 514*g*. Each slanted edge 514*f* slants away from a corresponding Teflon™ felt contact member 113. The slanted edges 514*f* are formed by cutting a rectangular film starting at near the center of each lengthwise edge and continuing to one of the widthwise edges in order to remove two-lengthwise opposing corners. The resulting shape of the lower film 514 includes a trapezoidal region that includes the slanted edges 514*f* and a rectangular region that includes the straight edges 514*g*. As viewed in FIG. 29, the lower film 514 is symmetrical at left and right sides. Therefore, the following explanation will be provided for one side only as viewed in FIGS. 30 to 34.

Because the straight edge 514*g* is shorter than the entire width of the lower film 514, the lower film 514 can be easily aligned with the attachment reference line in the same manner as the lower film 214 of the second embodiment.

Figure 30:
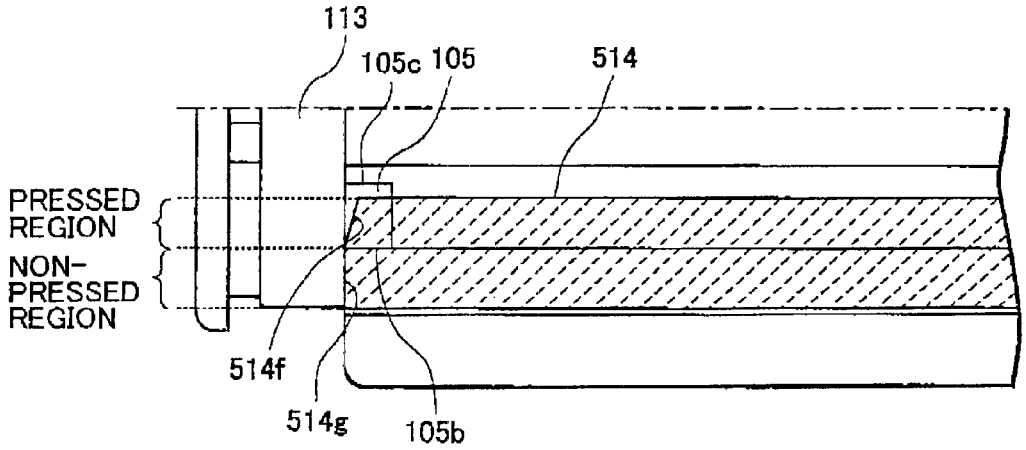
FIG. 30 is an enlarged view of the lower film of FIG. 29.
Figure 34:
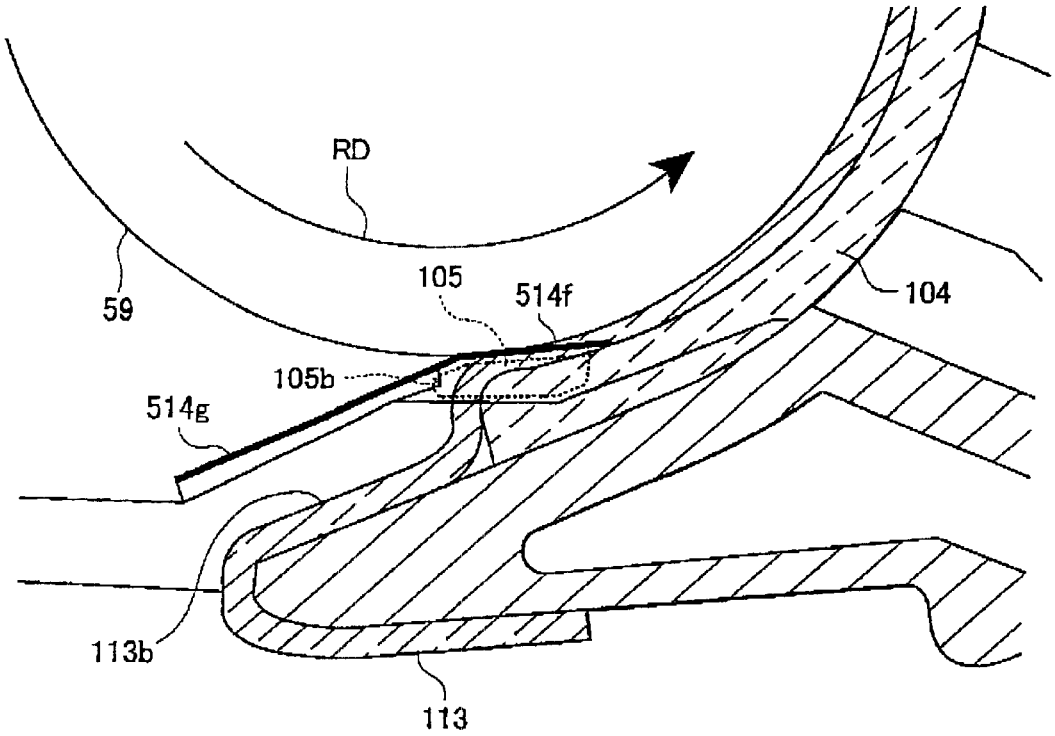
FIG. 34 is an enlarged view of FIG. 33.

As shown in FIG. 30, the lower film 514 is attached onto the lower seal attachment region 101 so as to completely cover an upstream edge 105*b* of the lower side seal 105. As shown in FIG. 34, the upstream edge 105*b* of the lower side seal 105 is the edge that is upstream with respect to the rotational direction RD of the developing roller 59. Because the lower film 514 totally covers the upstream edge 105*b* of the lower side seal 105, the upstream edge 105*b* will not scrape toner off the developing roller 59 when the developing roller 59 rotates in the rotational direction RD. If the upstream edge 105*b* were exposed, the toner would be scraped off by the upstream edge 105*b*, fall into the space in front of the upstream side of the lower side seal 105, and leak past the lower film 514. However, the lower film 514 of the present embodiment prevents this potential problem. Although a downstream edge 105*c* of the lower side seal 105 is exposed, the downstream edge 105*c* does not scrape toner from the developing roller 59 because the developing roller 59 moves from the upstream edge 105*b* toward the downstream edge 105*c*. Because the toner is maintained on the surface of the developing roller 59, toner leaks can be prevented.

As shown in FIGS. 30 to 34, the lower film 514 is attached onto the lower seal attachment region 101 so that the slanted edge 514*f* is located within a pressed region, where the developing roller 59 presses against the Teflon™ felt contact member 113, and so that the straight edge 514*g* is located within a non-pressed region, where the developing roller 59 does not press against the Teflon™ felt contact member 113. As best sent in FIG. 34, when the developing roller 59 is mounted in the developing case 51, the developing roller 59 presses against the Teflon™ felt contact member 113 where the slanted edge 514*f* is located, but not where the straight edge 514*g* is located. Because the slanted edge 514*f* is located at the pressed region, the lower film 514 will not contact the Teflon™ felt contact member 113 while the developing roller 59 is in a mounted condition in the developing case 51. If the lower film 514 contacted the Teflon™ felt contact member 113, if a portion of the lower film 514 is interposed between the developing roller 59 and the Teflon™ felt contact member 113 while the developing roller 59 is mounted, a gap equivalent to the thickness of the lower film 514 opens up between the developing roller 59 and the Teflon™ felt contact member 113 near the lengthwise edge of the lower film 514. Toner from the developing roller 59 can enter into this gap and leak out. However, with the configuration of the present embodiment, the lower film 514 will not become interposed between the developing roller 59 and the Teflon™ felt contact member 113, so such a leak can be prevented. Also, the lower side seal 105 prevents toner from leaking from the slanted edge 514*f* of the lower film 514. Also, the lower film 514 will not interfere with smooth rotation of the developing roller 59.

Figure 31:
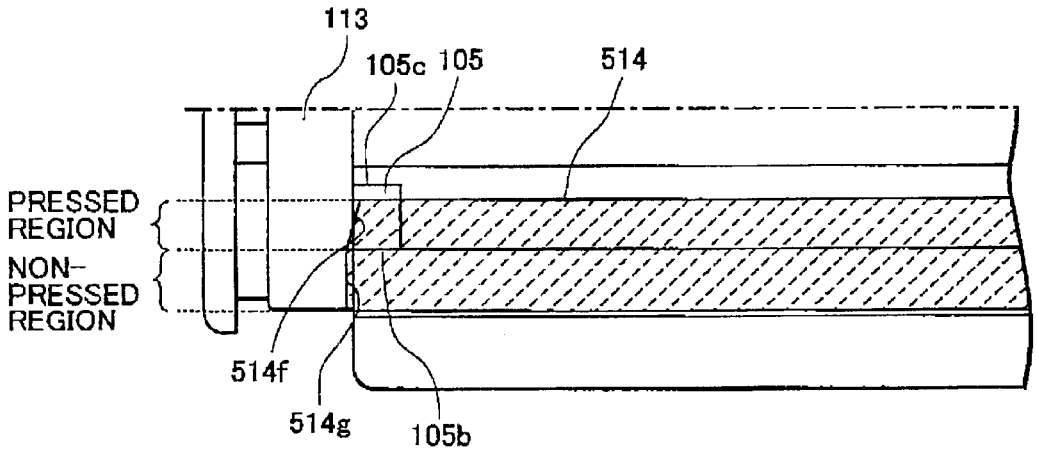
FIG. 31 is a plan view showing the lower film attached shifted out of place within a tolerance range.

As shown in FIG. 34, the Teflon™ felt contact member 113 extends beyond the end of the base seal 104, resulting in a step portion 113*b* that is lower than the rest of the Teflon™ felt contact member 113 with respect to the lower film 514. According to the present embodiment, the straight edge 514*g* is located at the step portion 113*b* of the Teflon™ felt contact member 113. With this configuration, the lower film 514 can be shifted out of position as shown in FIG. 31 when attached to the lower seal attachment region 101. Even though the lower film 514 will overlap with the Teflon™ felt contact member 113 in this case, the lower film 514 will not contact the Teflon™ felt contact member 113 as can be seen in FIG. 34. The lower film 514 and the Teflon™ felt contact member 113 will not interfere with each other, so that the developing roller 59 can rotate stably and toner leaks can be prevented.

Figure 32:
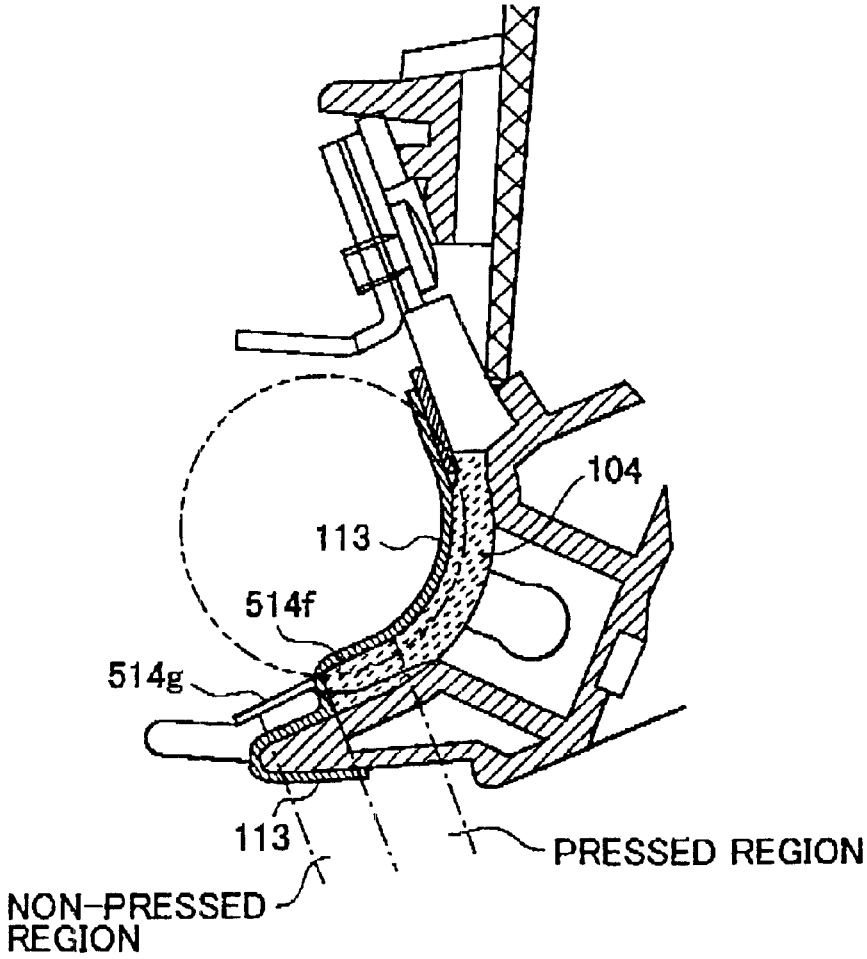
FIG. 32 is a cross-sectional view showing the developing device with the lower film of the fifth embodiment, before the developing roller is attached.
Figure 33:
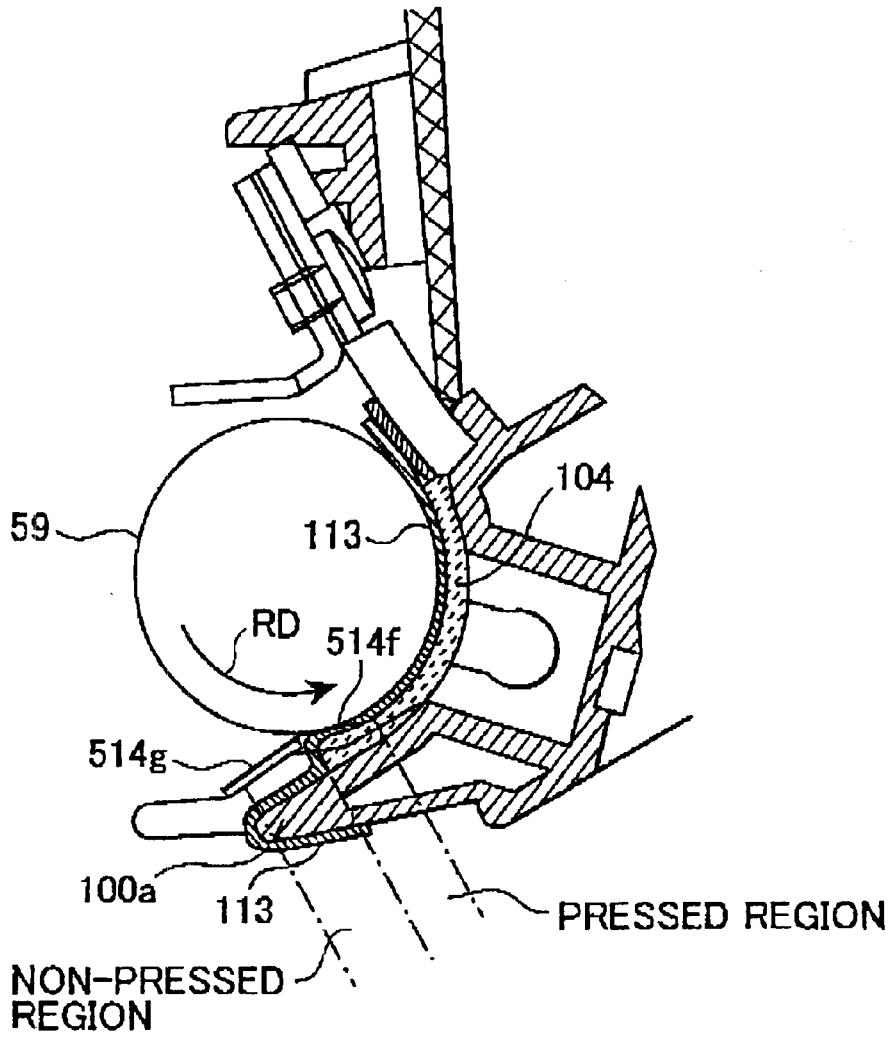
FIG. 33 is a cross-sectional view showing the developing device of FIG. 32 after the developing roller is attached.

FIGS. 32 and 33 show the condition of various seal members before and after the developing roller 59 is mounted in the developing case 51, respectively. As shown in FIG. 32, before the developing roller 59 is mounted, the Teflon™ felt contact member 113 is located higher than the lower film 514 in the pressed region and the lower film 514 is higher than the Teflon™ felt contact member 113 in the non-pressed region. As shown in FIGS. 33 and 34, when the developing roller 59 is mounted, then the lower film 514 and the Teflon™ felt contact member 113 are at the same level within the pressed region.

While the invention has been described in detail and with reference to specific embodiment thereof, it would be apparent to those skilled in the art that various changes and modifications may be made therein without departing from the spirit and scope of the invention.

For example, the lower film 414 can be divided into more than the two parts and can be divided into three or more parts. In this case, a seal portion similar to the central seal 119 can be provided between adjacent parts of the lower film. Also, the lower film 414 can be provided with exposure edges as in the second and third embodiments.

According to the embodiments, the drum cartridge case 2*a* that includes the developing unit 50 is freely detachable from the main body of the laser beam printer 1. However, only the developing unit 50 need be formed detachable from the main body of the image forming device 1. Alternatively, the drum cartridge case 2*a* and the developing unit 50 can be provided integrally in a process cartridge that is detachable from the main body of the laser beam printer 1. Further, the developing unit 50 need not be detachable from the main body of the laser beam printer 1 at all.

What is claimed is:

1. A developing device for developing a latent static-electric image into a visible image from developer, the developing device comprising:

a developing case for holding developer, the developing case being formed with an opening that extends in a lengthwise direction;

a developing roller disposed in the opening of the developing case and rotatably supported at lengthwise ends thereof on the developing case;

end leak prevention members disposed one at each lengthwise end of the developing roller in sliding contact with a peripheral surface of the developing roller;

lower side seals each disposed between the developing case and the developing roller and in between the end leak prevention members at a position adjacent to a corresponding end leak prevention member, each of the lower side seals having an upstream edge facing upstream with respect to rotation of the developing roller; and a lower film disposed between the developing case and the developing roller, the lower film completely covering the upstream edge of each of the lower side seals from contact with the developing roller, each of the lower side seals being partially exposed between the lower film and a corresponding end leak prevention member.

2. A developing device is claimed in claim 1, wherein a pressed region is defined between where the developing roller presses against the end leak prevention members, the lower side seals the being partially exposed at positions that correspond to the pressed region in the lenghtwise direction.

3. A developing device as claimed in claim 2, wherein the lower film has at each lengthwise edge thereof a slanting edge that slants away from a corresponding end leak prevention member of positions that correspond to the pressed region in the lengthwise direction, each lower side seal being exposed to contact with the developing roller through a space between the corresponding slanting edge and the corresponding end leak prevention member.

4. A developing device as claimed in claim 1, wherein the lower film covers the upstream edge of each lower side seal at positions that correspond, in the lengthwise direction, to a non-pressed region where the end leak prevention members are separated from the developing roller.

5. A developing device as claimed in claim 1, wherein the lower film has a width in a widthwise direction perpendicular to the lengthwise direction, the lower film having at each lengthwise edge thereof a straight edge that extends in the widthwise direction by a distance shorter than the width of the lower film.

6. A developing device for developing a latent static-electric image into a visible image from developer, the developing device comprising:

a developing case for holding developer, the developing case being formed with an opening that extends in a lengthwise direction;

a developing roller disposed in the opening of the developing case so as to extend in the lengthwise direction, the developing roller being rotatably supported at lengthwise ends thereof on the developing case;

end leak prevention members disposed one at each lengthwise end of the developing roller in sliding contact with a peripheral surface of the developing roller, a pressed region being defined between where the developing roller presses against the end leak prevention members; and a lower film disposed between the developing case and the developing roller with ends thereof located adjacent to corresponding end leak prevention members, the ends of the lower film being separated from the end leak prevention members at positions that correspond to the pressed region in the lengthwise direction.

7. A developing device as claimed in claim 6, wherein the lower film has at each lengthwise edge thereof a slanting edge that slants away from a corresponding end leak prevention member at positions that correspond to the pressed region in the lengthwise direction.

8. A developing device as claimed in claim 6, further comprising lower side seals each disposed between the developing case and the developing roller and in between the end leak prevention members at a position adjacent to a corresponding end leak prevention member, each of the lower side seals having an upstream edge facing upstream with respect to rotation of the developing roller; and wherein the lower film covers the upstream edge of each of the lower side seals at a position that corresponds, in the lengthwise direction, to a non-pressed region where the end leak prevention members are separated from the developing roller.

9. A developing device as claimed in claim 6, wherein the lower film has a width in a widthwise direction perpendicular to the lengthwise direction, the lower film having at each lengthwise edge thereof a straight edge that extends in the widthwise direction by a distance shorter than the width of the lower film.

10. A developing cartridge for developing, into a visible image from developer, a latent static-electric image formed on a photosensitive member of a process cartridge, the developing cartridge comprising:

a developing case adopted for free attachment to and detachment from the process cartridge, the developing case holding developer and being formed with an opening that extends in a lengthwise direction at a position corresponding to the photosensitive member of the process cartridge;

a developing roller disposed in the opening of the developing case so as to be in confrontation with the photosensitive member when the developing case is attached to the process cartridge, the developing roller being rotatably supported at lengthwise ends thereof on the developing case;

end leak prevention members disposed one at each lengthwise end of the developing roller in sliding contact with a peripheral surface of the developing roller;

lower side seals each disposed between the developing case and the developing roller and in between the end leak prevention members at a position adjacent to a corresponding end leak prevention member, each of the lower side seals having an upstream edge facing upstream with respect to rotation of the developing roller; and a lower film disposed between the developing case and the developing roller, the lower film completely covering the upstream edge of each of the lower side seals from contact with the developing roller, each of the lower side seals being partially exposed between the lower film and a corresponding end leak prevention member.

11. A developing cartridge as claimed in claim 10, wherein a pressed region is defined between where the developing roller presses against the end leak prevention members, the lower side seals being partially exposed at positions that correspond to the pressed region in the lengthwise direction.

12. A developing cartridge as claimed in claim 11, wherein the lower film has at each lengthwise edge thereof a slanting edge that slants away from a corresponding end leak prevention member at positions that correspond to the pressed region in the lengthwise direction, each lower side seal being exposed to contact with the developing roller through a space between the corresponding slanting edge and the corresponding end leak prevention member.

13. A developing cartridge as claimed in claim 10, wherein the lower film covers the upstream edge of each of the lower side seals at a position that corresponds, in the lengthwise direction, to a non-pressed region where the end leak prevention members are separated from the developing roller.

14. A developing cartridge as claimed in claim 10, wherein the lower film has a width in a widthwise direction perpendicular to the lengthwise direction, the lower film having at each lengthwise edge thereof a straight edge that extends in the widthwise direction by a distance shorter than the width of the lower film.

15. A developing cartridge for developing, into a visible image from developer, a latent static-electric image formed on a photosensitive member of a process cartridge, the developing cartridge comprising:

a developing case adopted for free attachment to and detachment from the process cartridge, the developing case holding developer and being formed with an opening that extends in a lengthwise direction at a position corresponding to the photosensitive member of the process cartridge;

a developing roller disposed in the opening of the developing case so as to be in confrontation with the photosensitive member when the developing case is attached to the process cartridge, the developing roller being rotatably supported at lengthwise ends thereof on the developing case;

end leak prevention members disposed one at each lengthwise end of the developing roller in sliding contact with a peripheral surface of the developing roller, a pressed region being defined between where the developing roller presses against the end leak prevention members; and a lower film disposed between the developing case and the developing roller with ends thereof located adjacent to corresponding end leak prevention members, the ends of the lower film being separated from the end leak prevention members at positions that correspond to the pressed region in the lengthwise direction.

16. A developing cartridge as claimed in claim 15, wherein the lower film has at each lengthwise edge thereof a slanting edge that slants away from a corresponding end leak prevention member at positions that correspond to the pressed region in the lengthwise direction.

17. A developing cartridge as claimed in claim 15, wherein the lower film covers the upstream edge of each lower side seal at positions that correspond, in the lengthwise direction, to a non-pressed region where the end leak prevention members are separated from the developing roller.

18. A developing cartridge as claimed in claim 15, wherein the lower film has a width in a widthwise direction perpendicular to the lengthwise direction, the lower film having at each lengthwise edge thereof a straight edge that extends in the widthwise direction by a distance shorter than the width of the lower film.

* * * * *